US011828035B2

(12) United States Patent
Yoo

(10) Patent No.: US 11,828,035 B2
(45) Date of Patent: Nov. 28, 2023

(54) ANCHOR FOUNDATION MECHANISM WITH EASE OF FIXING AND INCREASED FIXING FORCE FOR POST

(71) Applicant: Dong Sik Yoo, Gyeongsan-si (KR)

(72) Inventor: Dong Sik Yoo, Gyeongsan-si (KR)

( * ) Notice: Subject to any disclaimer, the term of this patent is extended or adjusted under 35 U.S.C. 154(b) by 390 days.

(21) Appl. No.: 17/278,032

(22) PCT Filed: Sep. 19, 2019

(86) PCT No.: PCT/KR2019/012118
§ 371 (c)(1),
(2) Date: Aug. 9, 2021

(87) PCT Pub. No.: WO2020/060212
PCT Pub. Date: Mar. 26, 2020

(65) Prior Publication Data

US 2021/0372071 A1 Dec. 2, 2021

(30) Foreign Application Priority Data

Sep. 21, 2018 (KR) ..... 10-2018-0113551

(51) Int. Cl.
*E02D 27/42* (2006.01)
*E02D 5/80* (2006.01)
(Continued)

(52) U.S. Cl.
CPC ..... *E02D 27/42* (2013.01); *E01F 9/685* (2016.02); *E02D 5/801* (2013.01); *E02D 5/803* (2013.01);
(Continued)

(58) Field of Classification Search
CPC ..... E02D 27/42; E02D 5/801; E02D 5/803; E02D 27/50; E02D 2600/20; E02D 2600/30; E01F 9/685
See application file for complete search history.

(56) References Cited

U.S. PATENT DOCUMENTS 3,763,655 A * 10/1973 Galuska ..... E02D 5/54 52/158
5,975,808 A * 11/1999 Fujita ..... E02D 5/523 405/253

(Continued)

FOREIGN PATENT DOCUMENTS

JP 2004-324321 A 11/2004
JP 2009-062762 A 3/2009

(Continued)

OTHER PUBLICATIONS

International Search Report for PCT/KR2019/012118 dated Jan. 22, 2020 from Korean Intellectual Property Office.

*Primary Examiner* — Kyle Armstrong

(74) *Attorney, Agent, or Firm* — Paratus Law Group, PLLC

(57) ABSTRACT

An anchor foundation mechanism includes: a vertical cylindrical tubular body formed to be inserted into the ground and having a receiving space therein; a cover part fixed to the bottom of the body by bolts and configured to be easily inserted into the ground; a support integrally formed with the top of the body and having a plurality of through-holes and an installation fixing bolt flange so as to allow the support to be fixed to a facility post after being exposed on the ground; and an anchor assembly formed in the receiving space of the body and having anchor pins for driving the body deeply into the ground and then tightly fixing the body so as to support a load and prevent rotation, and prevent forced pulling out.

4 Claims, 24 Drawing Sheets

(51) Int. Cl.
*E02D 27/50* (2006.01)
*E01F 9/685* (2016.01)

(52) U.S. Cl.
CPC ..... *E02D 27/50* (2013.01); *E02D 2600/20* (2013.01); *E02D 2600/30* (2013.01)

(56) References Cited

U.S. PATENT DOCUMENTS

| | | | | |
|---|---|---|---|---|
| 7,736,095 | B2 * | 6/2010 | Fujita | E02D 5/805 405/253 |
| 8,875,451 | B1 * | 11/2014 | Parduhn | E04H 12/2223 52/165 |
| 10,526,758 | B1 * | 1/2020 | Martin | E01F 15/0461 |
| 2005/0232707 | A1 * | 10/2005 | Reinert | E02D 27/42 405/232 |
| 2014/0263927 | A1 * | 9/2014 | Scott | E01F 9/681 248/530 |
| 2015/0191886 | A1 * | 7/2015 | Okobi | E04H 12/2269 52/157 |

FOREIGN PATENT DOCUMENTS

| | | | |
|---|---|---|---|
| JP | 2016-217093 | A | 12/2016 |
| KR | 10-0881863 | B1 | 2/2009 |
| KR | 10-1060165 | B1 | 9/2011 |
| KR | 10-2016-0110055 | A | 9/2016 |
| KR | 10-1842153 | B1 | 3/2018 |
| KR | 10-1986458 | B1 | 6/2019 |

* cited by examiner

ANCHOR FOUNDATION MECHANISM WITH EASE OF FIXING AND INCREASED FIXING FORCE FOR POST

CROSS-REFERENCE TO PRIOR APPLICATIONS

This application is a National Stage Patent Application of PCT International Patent Application No. PCT/KR2019/012118 (filed on Sep. 19, 2019) under 35 U.S.C. § 371, which claims priority to Korean Patent Application No. 10-2018-0113551 (filed on Sep. 21, 2018), which are all hereby incorporated by reference in their entirety.

BACKGROUND

The present disclosure relates to an anchor foundation mechanism with ease of fixing and an increased fixing force for a post, and more particularly, to an anchor foundation mechanism with ease of fixing and an increased fixing force for a post capable of firmly fixing a post supporting a base pillar of a streetlight, a traffic light, a road signpost, a communication tower, solar power, or various fences inside the ground to secure safety, obtaining a precise fixing force with ease of work and installation convenience by driving the anchor foundation mechanism inserted into the ground drilled with an auger drill deeply into the inner side of the ground through anchor pins of an anchor assembly for close fixing, keeping a neat appearance by configuring electric wires or additional facilities installed on a streetlight or a traffic light to be supplied with electric power so as not to be exposed to the outside, preventing rotation and preventing forcible pulling out by external pressure by configuring an anti-rotation plate to support the post from numerous pressures applied on the post, and smoothly recovering the anchor foundation mechanism by returning the anchor pins of the anchor foundation mechanism to their original positions located inside when the facility reaches its end of life or moves its location.

In general, a variety of road facilities are installed on the side of the road to induce or control the smooth passage of people and vehicles. The road facilities are provided in the form of streetlights, traffic lights, road signposts, communication towers, solar power, various fences, or the like, and the road facilities are installed on one side of the road or in a certain space when a facility for solar power is installed, by using a post. In this case, when the post collapses and is pulled out by external pressure such as strong wind or heavy load, it is not possible to guarantee the safety of citizens, and thus close support and fixation should be supported. However, posts are still often overturned, collapsed, and pulled out by natural disasters such as typhoons, earthquakes, and hurricanes.

As an example, Korean Patent No. 1060165 discloses a post anchor box for bridge rails in which a seating groove 11 with a top portion being open is formed in an upper part so that a post 20 is seated therein; first bolt fastening holes 12 are formed on both sides of the upper part so that screw bolts 1 for fixing the post 20 seated in the seating groove 11 is fastened through; a support plate 13 for connecting and supporting both side walls is provided at a lower part; a second bolt fastening hole 14 is formed in the support plate 13 so that an anchor bolt 2 is vertically fastened for fixing to the ground, the seating groove 11 is formed in a horizontal plane with both sides open to form a predetermined length, making it possible to adjust the seating position of the post 20; and guide protrusions 15 are provided in a symmetrical shape on both sides of the upper part to form the seating groove 11 in the center and through-holes 12' are formed outside the guide protrusions 15 to prevent external exposure after screw bolts 1 for fastening are inserted through the first bolt fastening holes 12.

However, since the post anchor box for the bridge rails is fixed through screw bolts for overall support, the fixing force may not be obtained as expected, and there is considerable concern that the post may be dislodged when a natural disaster such as a typhoon or earthquake occurs.

As another example, Korean Patent No. 0881863 discloses a concrete supporting pole installed with anchor bolts in which an anchor bolt connection socket 20 made of a metal material is installed at a lower portion of a supporting pole body 12 of the concrete supporting pole, and the anchor bolt connection socket 20 includes: a disc-shaped flange portion 22 having a plurality of anchor bolt fastening holes 22*a* formed around a large diameter and into which respective anchor bolts B are inserted and a plurality of tension-bar connection holes 22*b* formed in a circumference of a small diameter and connected to ends of the tension-bars buried in the concrete supporting pole; and a cylindrical boss portion 24 positioned between the anchor bolt fastening holes 22*a* and the tension-bar connection holes 22*b* and installed at a predetermined height on the disc-shaped flange portion 22.

However, the concrete supporting pole installed with the anchor bolts are simply formed in a structure of being fixed on the concrete supporting pole with anchor bolts and has to exert a fixing force with only the part of the concrete supporting pole inserted inside, which may result in a limitation of the fixing force.

As still another example, Korean Patent No. 1842153 discloses a variable type base structure SB for separating a solar panel P from a bottom E by a predetermined distance, in which a lower part of a fixed support 10 is fixed to the bottom E, a plurality of through-holes 12 are formed in an upper part in a vertical direction, the plurality of through-holes 12 are communicated with each other by bolt guide holes 13 and the width of the bolt guide hole 13 is formed smaller than the diameter of the through-hole 12, a fixed bracket 20 is provided at the upper part of the fixed support 10 and the fixed bracket 20 is provided with a flange 21 to which the solar panel P is coupled, the flange 21 has a plurality of elongated holes 21*a* formed radially and are selectively screwed and coupled among the plurality of elongated holes 21*a* depending on the coupling direction of the solar panel P, a pair of bracket arms 22 are formed to be perpendicular to each other to a lower portion of the flange 21 such that the upper part of the fixed support 10 is provided between the bracket arms 22, a hinge hole 23 is formed in the bracket arm 22, the bracket arm 22 is formed with an arc-shaped slope guide hole 24 along a certain distance around the hinge hole 23, a slope of the fixed bracket 20 is adjusted by a hinge bolt 30 penetrating the hinge hole 23, the hinge bolt 30 is formed of a bolt head 31 and a bolt body 32, the bolt body 32 is formed of a threaded portion 32*a* on which a thread is formed and a threadless portion 32*b* having a relatively small diameter without a thread such that the threadless portion 32*b* is guided along the bolt guide hole 13, the height of the fixed bracket 20 is adjusted by being fixed by a fixing means in a state in which the threaded portion 32*a* of the hinge bolt 30 has passed through a through-hole 12 having a corresponding height, and the fixed bracket 20 is fixed to the fixed support 10 with the adjusted slope by the bracket fixed hole 40 penetrating an arc-shaped slope guide hole 24 and the through-hole 12 of the fixed support 10, thereby making it possible to flexibly adjust the angle.

However, for the variable solar panel foundation structure that is inserted in the ground in a general form, it is not possible to support the solar panel foundation structure when pressure is generated due to natural disasters such as typhoons, earthquakes, hurricanes, or the like, and there is a problem that the structure is often rotated, deviated, or collapsed, accordingly.

SUMMARY

In order to fundamentally improve the problems described above, an object of the present disclosure is to provide an anchor foundation mechanism with ease of fixing and an increased fixing force for a post capable of firmly fixing a post supporting a base pillar of a streetlight, a traffic light, a road signpost, a communication tower, solar power, or various fences inside the ground to secure safety, obtaining a precise fixing force with ease of work and installation convenience by driving the anchor foundation mechanism inserted into the ground drilled with an auger drill deeply into the inner side of the ground through anchor pins of an anchor assembly for close fixing, keeping a neat appearance by configuring electric wires or additional facilities installed on a streetlight or a traffic light to be supplied with electric power so as not to be exposed to the outside, preventing rotation and preventing forcible pulling out by external pressure by configuring an anti-rotation plate to support the post from numerous pressures applied on the post, and smoothly recovering the anchor foundation mechanism by returning the anchor pins of the anchor foundation mechanism to their original positions located inside when the facility reaches its end of life or moves its location.

In order to achieve the above object, according to the present disclosure, an anchor foundation mechanism that fixes a post for supporting a facility of a streetlight, a traffic light, a road signpost, a communication tower, solar power, and various fences to a ground includes: a cylindrical vertical tubular body formed to be inserted into the ground and having a receiving space therein; a cover part fixed to a bottom of the body by bolts and configured to be easily inserted into the ground; a support integrally formed with a top of the body and provided with a plurality of through-holes and a facility fixing bolt flange to allow the support to be fixed to the facility post after being exposed on the ground; and an anchor assembly formed in the receiving space of the body and having anchor pins for driving the body deeply into the ground and then tightly fixing the body so as to support a load and prevent forced pulling out.

Furthermore, according to the present disclosure, the body may further include a plurality of inlet holes that communicate with the receiving space and through which an electric wire, an ELP conduit, and a ground wire are inserted to facilitate power supply.

Furthermore, according to the present disclosure, the body may further include an anti-rotation plate for preventing rotation or subsidence from pressure by wind, typhoon, hurricane, earthquake, or the like applied to the facility post.

In addition, according to the present disclosure, the cover part may have a cone-shaped cover and a screw formed on an outer surface such that a degree of insertion into the ground is adjusted by using a rotary tool.

In addition, according to the present disclosure, when the diameter pi(φ) of the body is approximately 150 mm or less, the anchor assembly may use two anchor pins, and may further include a support portion supported through a plurality of rails between an upper support and a lower support fixed to an inside of the body; an anchor pin house having rail grooves to accommodate the rails of the support portion to enable up and down transfer and receiving the anchor pins to hold the anchor pins such that the anchor pins do not move right and left when the anchor pins are fully open; a plurality of anchor pins having a side pin and a side pin hole on the transfer base such that the anchor pins move well, and slowly inserted and fixed inside the ground while pushing a protruding cover outward from an inclined groove by downward transfer of the transfer base; and a foreign matter blocking seal preventing foreign matter, groundwater, or the like from entering to prevent the anchor pin from sticking on both sides where side pins are inserted on the anchor pins.

In addition, according to the present disclosure, the anchor assembly may include: a support portion supported through a plurality of rails between an upper support and a lower support fixed to an inside of the body; a transfer base having rail grooves to accommodate the rails of the support portion to allow the transfer base to transfer up and down and having a center bolt through-hole such that a center bolt is inserted into the center of the transfer base; a center bolt fastened to a center bolt tab of the lower support by inserting the center bolt into the center bolt through-hole of the transfer base and then moving the transfer base up and down through rotation of the center bolt through a joint box; a washer and a snap ring supporting the transfer base to the center bolt; and a plurality of anchor pins having a side pin on the transfer base such that the anchor pins of the anchor foundation mechanism move well, and slowly inserted and fixed inside the ground while pushing the protruding cover outward from an inclined groove by downward transfer of the transfer base through rotation of the center bolt. In this case, the washer and the snap ring fastened to the center bolt may prevent the free fall of the transfer base and support the transfer base when the anchor pin is returned to its original position by rotating the center bolt in reverse, and thus may serve to return the anchor pin to the original position in the body of the anchor foundation mechanism.

In addition, according to the present disclosure, when the diameter pi(φ) of the body is 150 mm or more, the anchor assembly may use three or four anchor pins, and may include: a support portion supported through a plurality of rails between an upper support and a lower support; an anchor pin house having rail grooves to accommodate the rails of the support portion to enable up and down transfer and receiving the anchor pins to hold the anchor pins such that the anchor pins do not move right and left when the anchor pins are fully open; and a plurality of anchor pins having a side pin and a side pin hole on the transfer base such that the anchor pins move well and having a rock bolt hole for a rock bolt to pass through and tab bolts on a side thereof for preventing a transfer base from falling freely, in which by lowering a hydraulic power tool (not shown) in a state of connecting a lower fastening bolt of a fastening tool to a fastening nut provided in the center of the transfer base and connecting an upper part of the fastening tool to the hydraulic power tool with a U-shaped connecting pin and lowing the transfer base by the force of the hydraulic power tool, the anchor pins slowly insert and fix the anchor foundation mechanism inside the ground while pushing the protruding cover outward from an inclined groove by the downward transfer, and when the transfer base is completely lowered, the rock bolt fixed to the lower support passes through the rock bolt hole of the transfer base and the nut is fastened to the rock bolt to fix the transfer base such that it does not move upward.

In addition, when fixing the flange of the support and fixing parts of the facility post with a facility fixing bolt, an insulation plate and an insulation washer may be inserted between the fixing parts and fixed with a nut to block micro-current rising from the inside of the ground, protecting people and facilities.

In addition, all parts used in the anchor foundation mechanism may be basically subjected to plating treatment to prevent corrosion as much as possible. In addition, according to the present disclosure, the body may further include a protruding cover bent upward while being connected in an integrated state when the anchor pin protrudes to the outside, in which the cover is entirely cut but two upper portions are connected by about 2 mm so as to be opened in an upper direction by the anchor pins protruding to the outside while preventing inflow of foreign matter into the receiving space of the body when being inserted inside the ground.

Meanwhile, terms or words used in the present specification and claims should not be construed as being limited to their usual or dictionary meanings, but should be construed as a meaning and concept consistent with the technical idea of the present disclosure based on the principle that the inventor can appropriately define the concept of terms in order to describe the inventor's own invention in the best way. Therefore, the embodiments described in the present specification and the configurations shown in the drawings are only the most preferred embodiment of the present disclosure, and do not represent all the technical spirit of the present disclosure, and thus, it should be understood that there may be equivalents and variations.

As described above, according to the present disclosure, it is possible to firmly fix a post supporting a base pillar of a streetlight, a traffic light, a road signpost, a communication tower, solar power, or various fences inside the ground to secure safety, to obtain a precise fixing force with ease of work and installation convenience by driving the anchor foundation mechanism inserted into the ground drilled with an auger drill deeply into the inner side of the ground through anchor pins of an anchor assembly for close fixing, to keep a neat appearance by configuring electric wires or additional facilities installed on a streetlight or a traffic light to be supplied with electric power so as not to be exposed to the outside, to prevent rotation and prevent forcible pulling out by external pressure by configuring an anti-rotation plate to support the post from numerous pressures applied on the post, and to smoothly recover the anchor foundation mechanism by returning the anchor pins of the anchor foundation mechanism to their original positions located inside when the facility reaches its end of life or moves its location.

DETAILED DESCRIPTION

Figure 1:
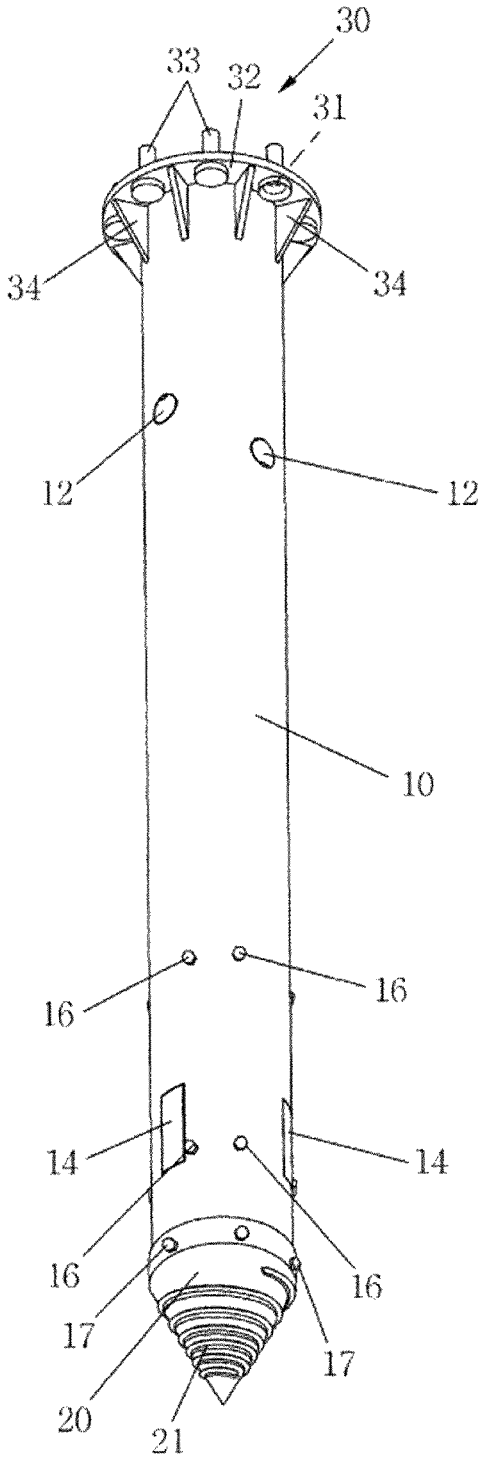
FIG. 1 is a perspective view of an anchor foundation mechanism according to the present disclosure.
Figure 2A:
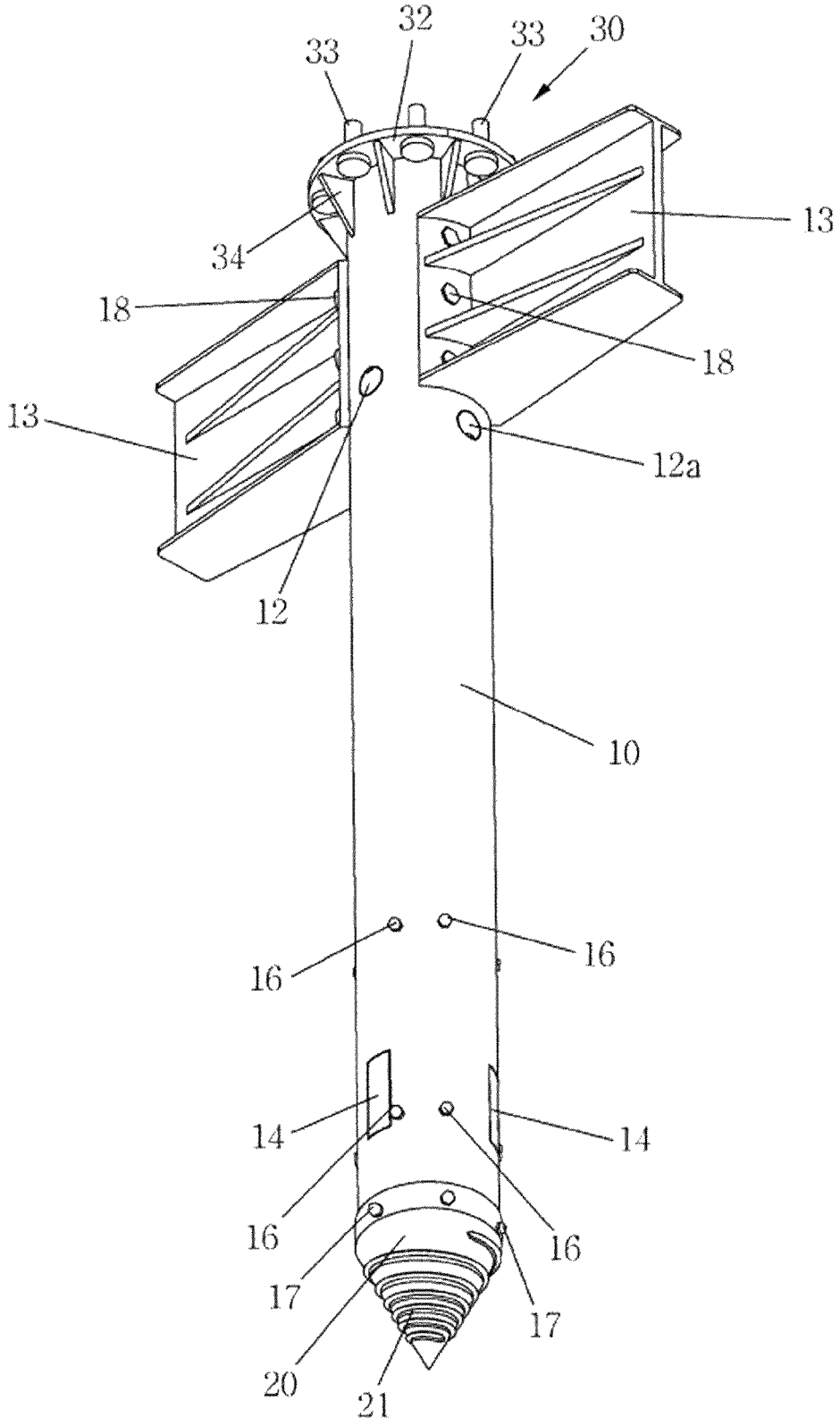
FIGS. 2*a* and 2*b* are a perspective view and a front view of an anchor foundation mechanism according to an embodiment of the present disclosure.
Figure 2B:
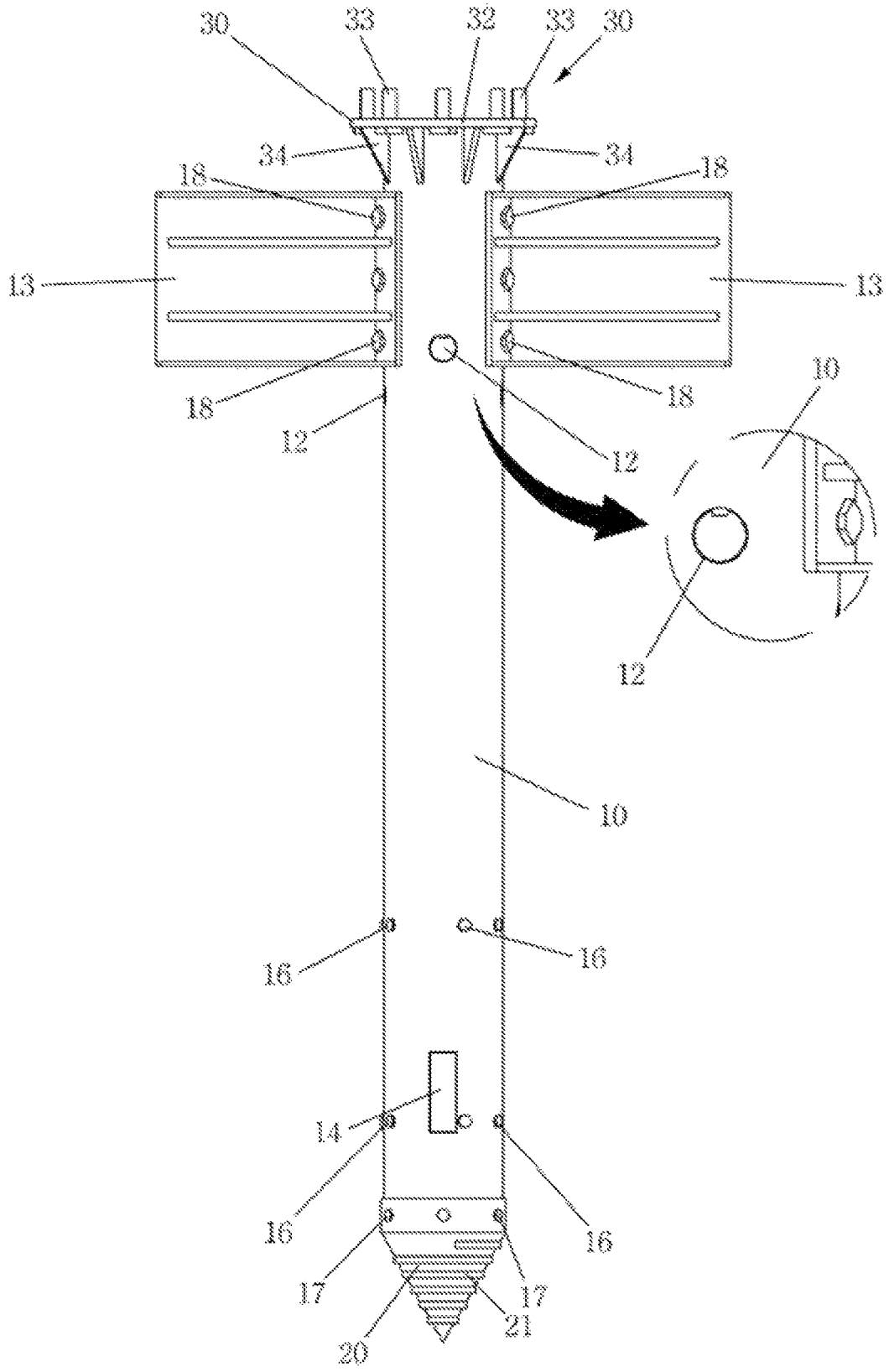
Figure 3:
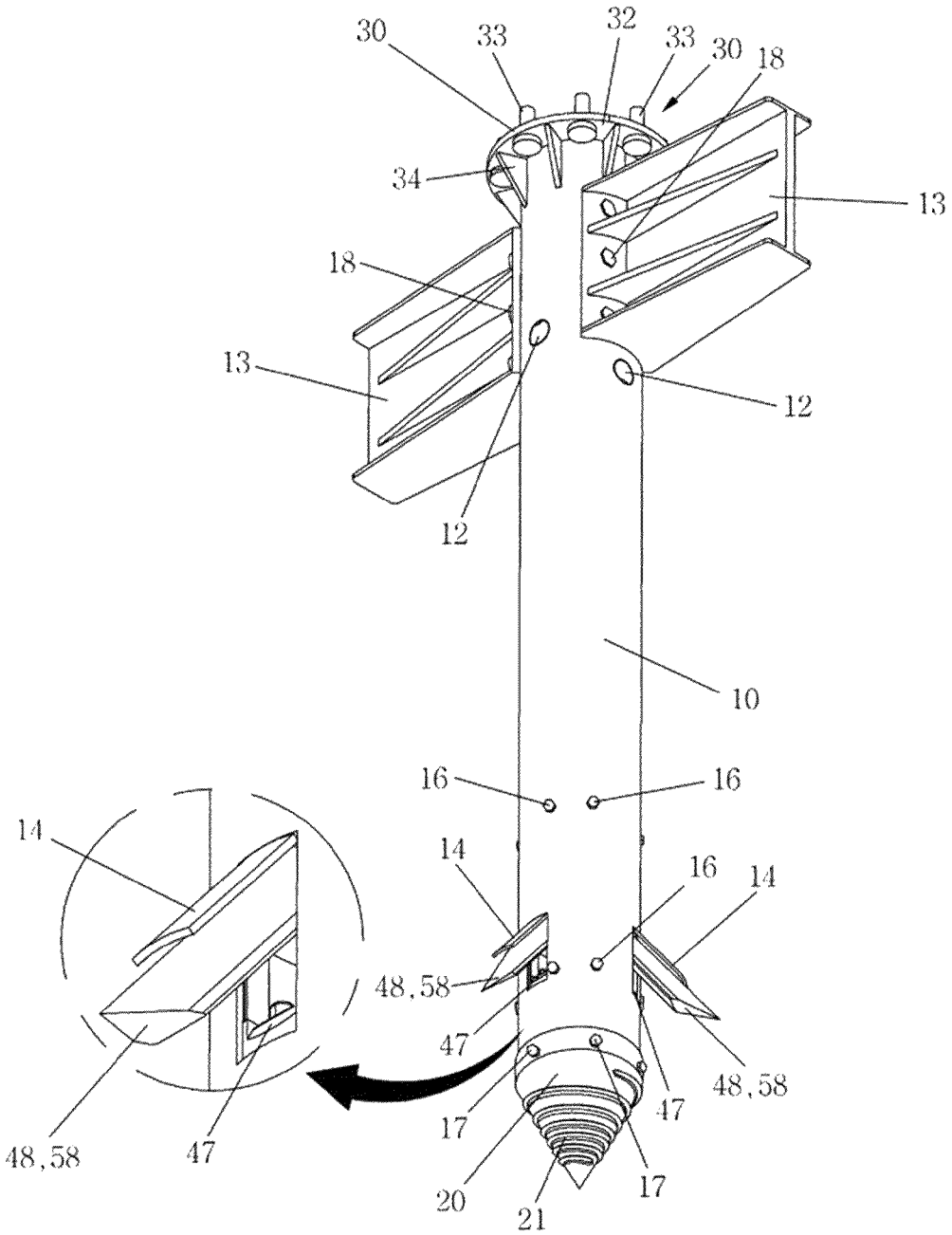
FIG. 3 is a perspective view illustrating an operating state of an anchor foundation mechanism according to the present disclosure.
Figure 4A:
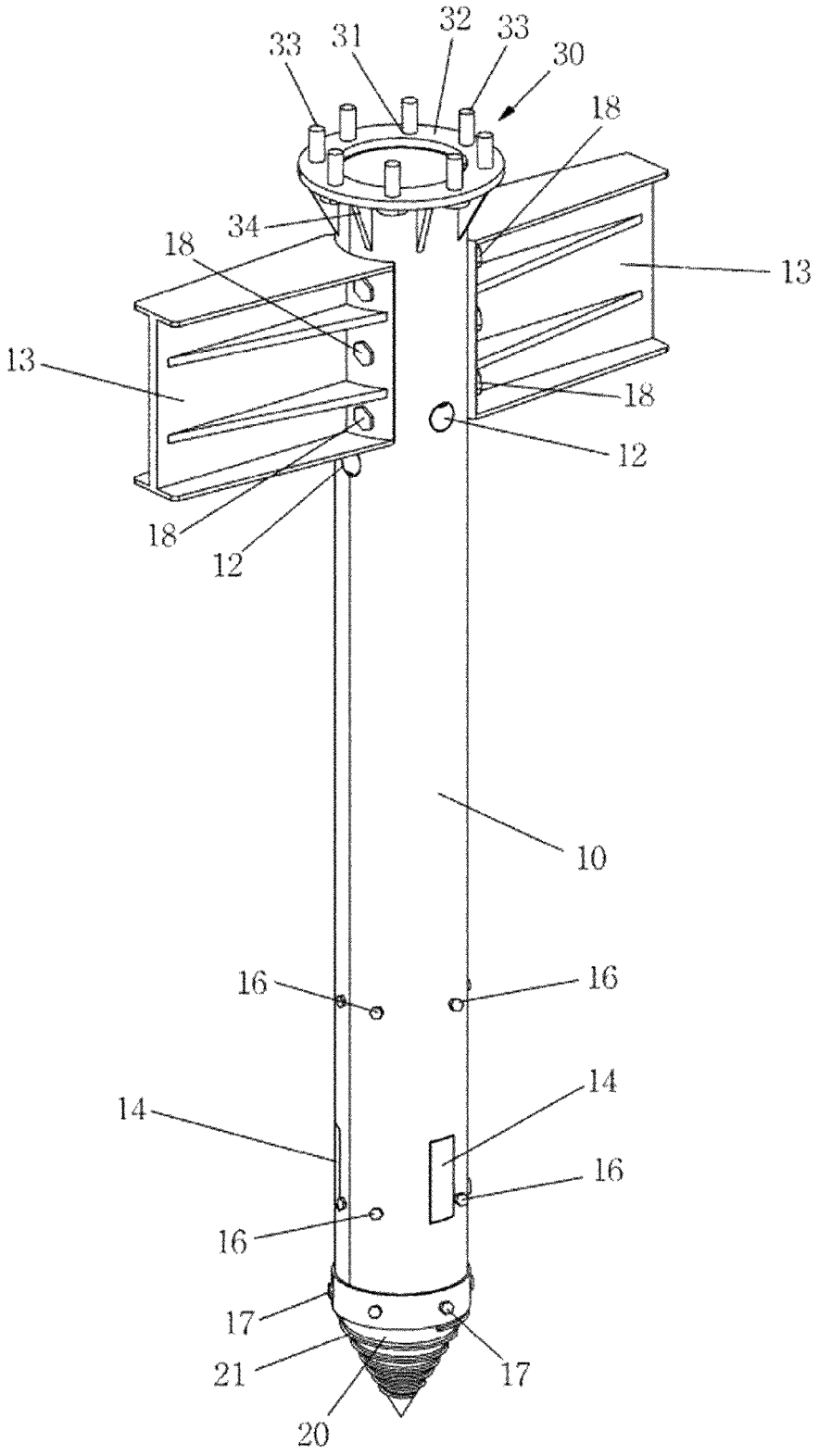
FIGS. 4*a* to 4*c* are perspective views sequentially illustrating an operating state of an anchor foundation mechanism according to the present disclosure.
Figure 4B:
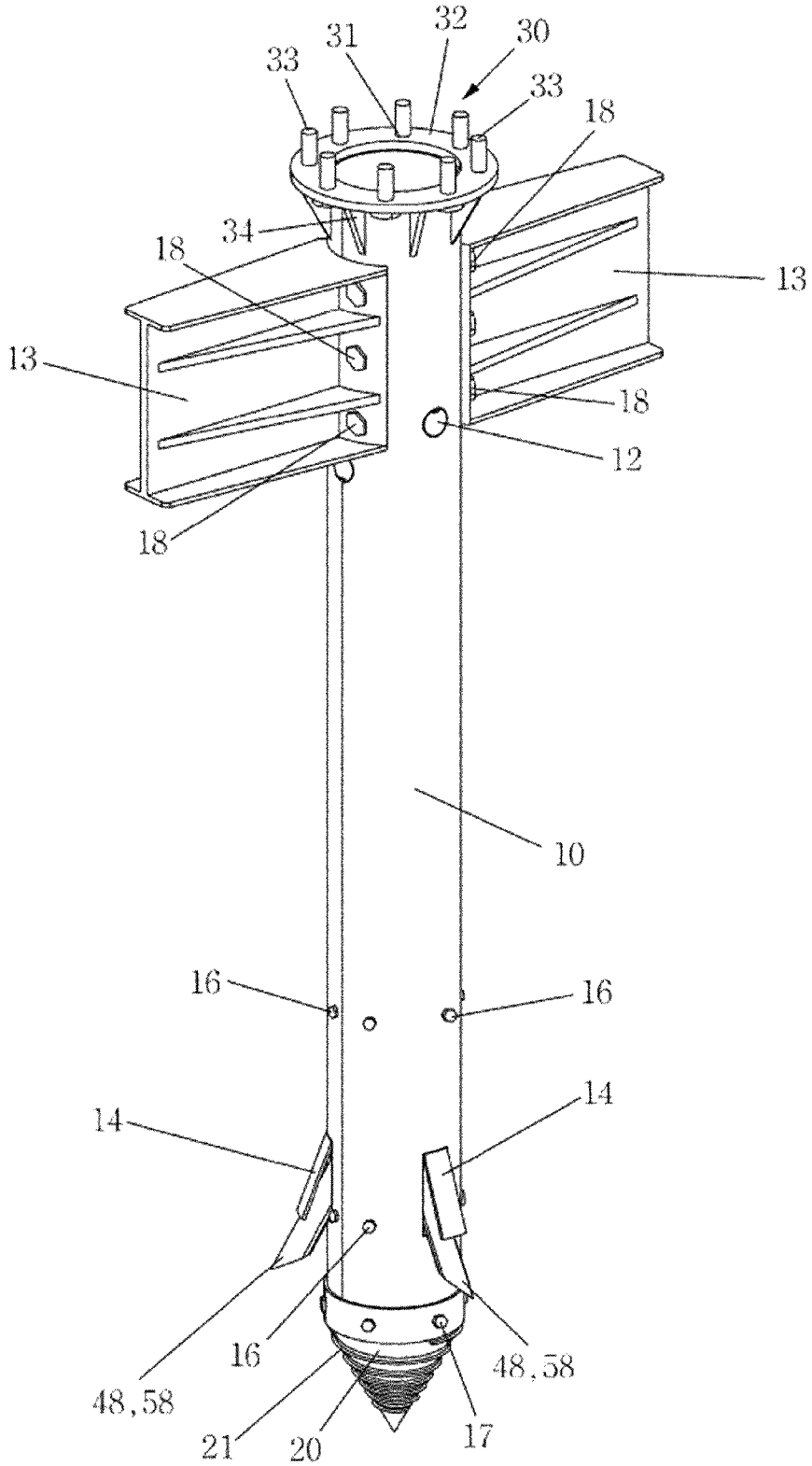
Figure 4C:
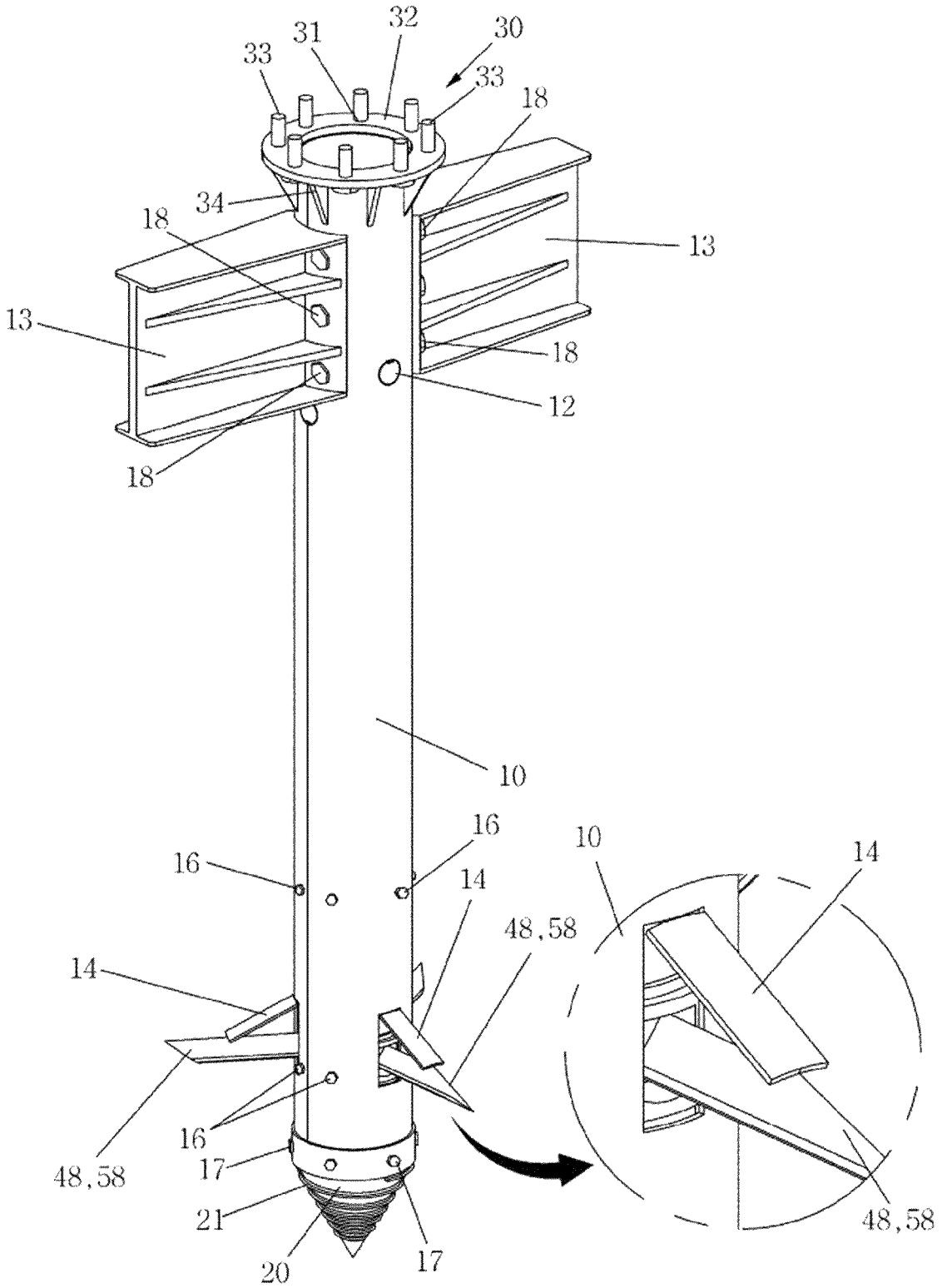
Figure 5:
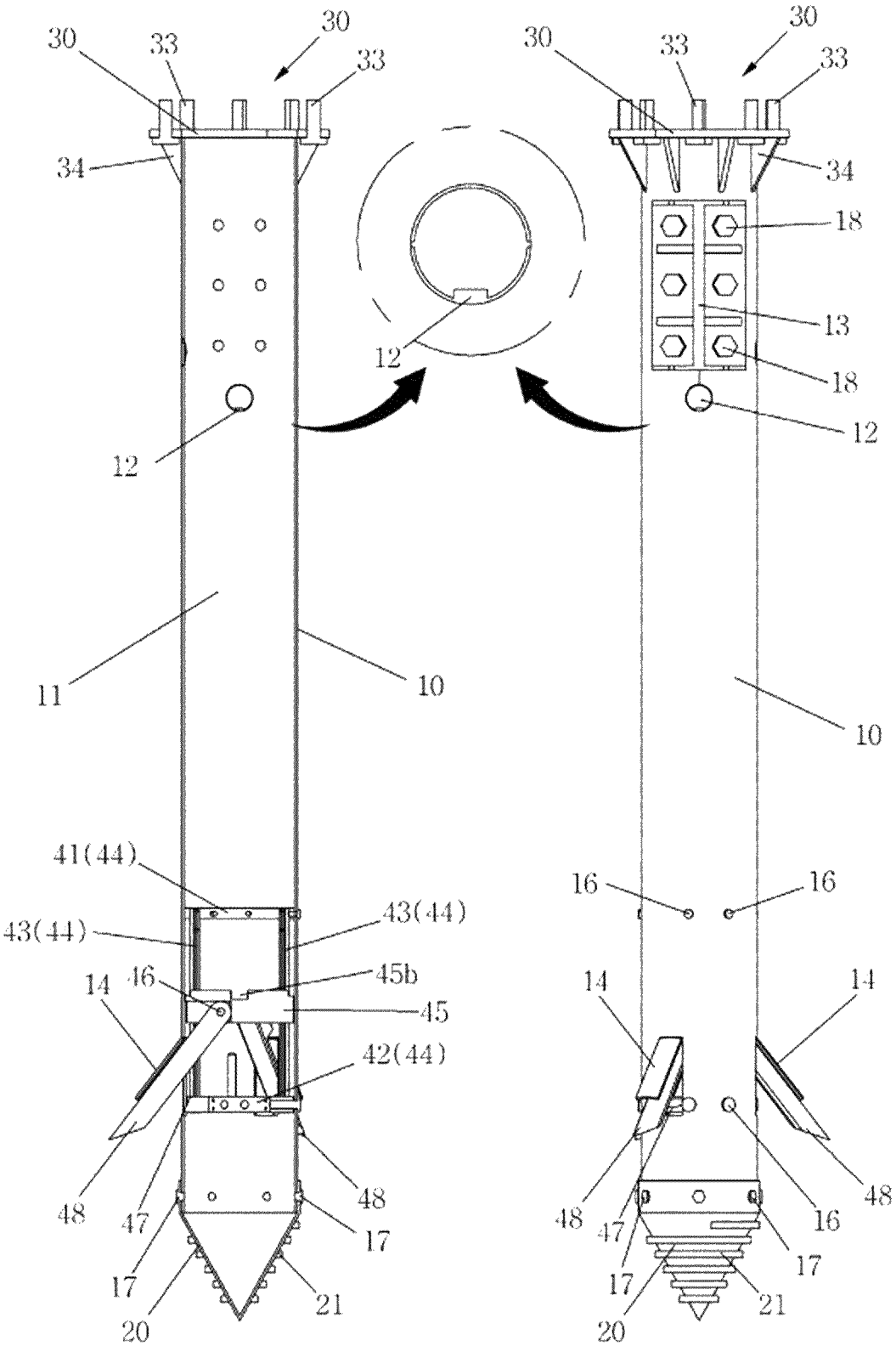
FIG. 5 is a cross-sectional view and a front view illustrating an operating state of an anchor foundation mechanism according to the present disclosure.
Figure 6:
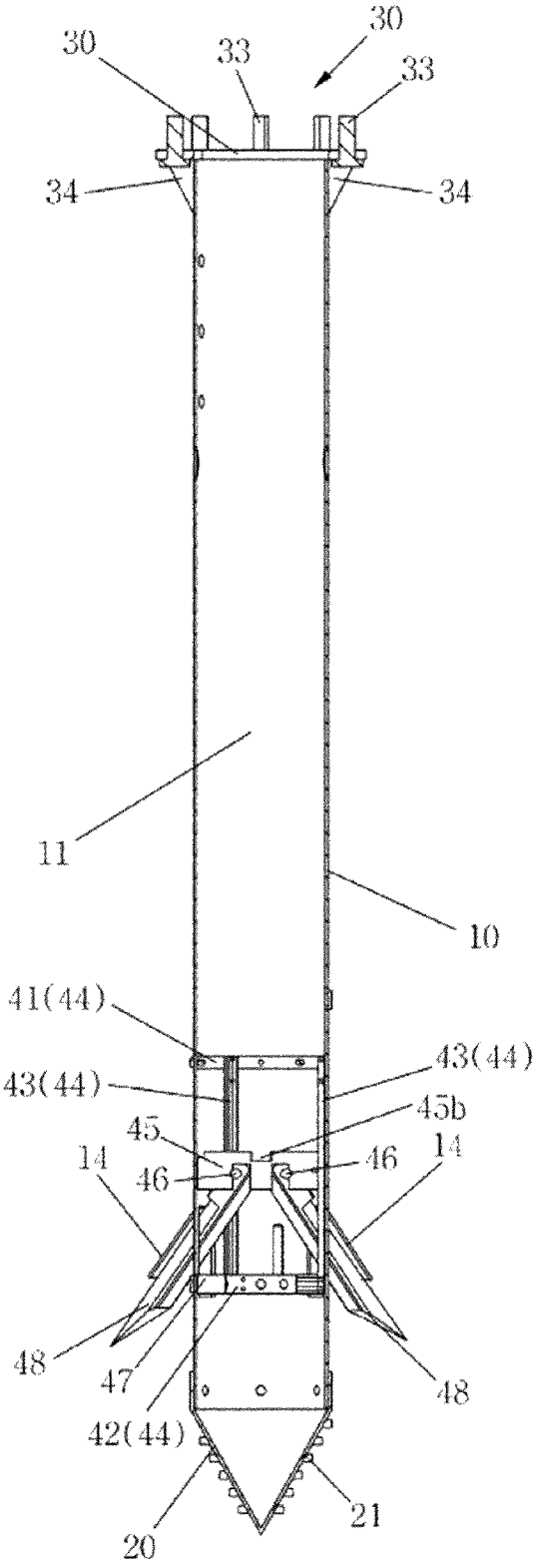
FIG. 6 is a cross-sectional view of an operating state of an anchor foundation mechanism according to the present disclosure as viewed from a different angle.
Figure 7A:
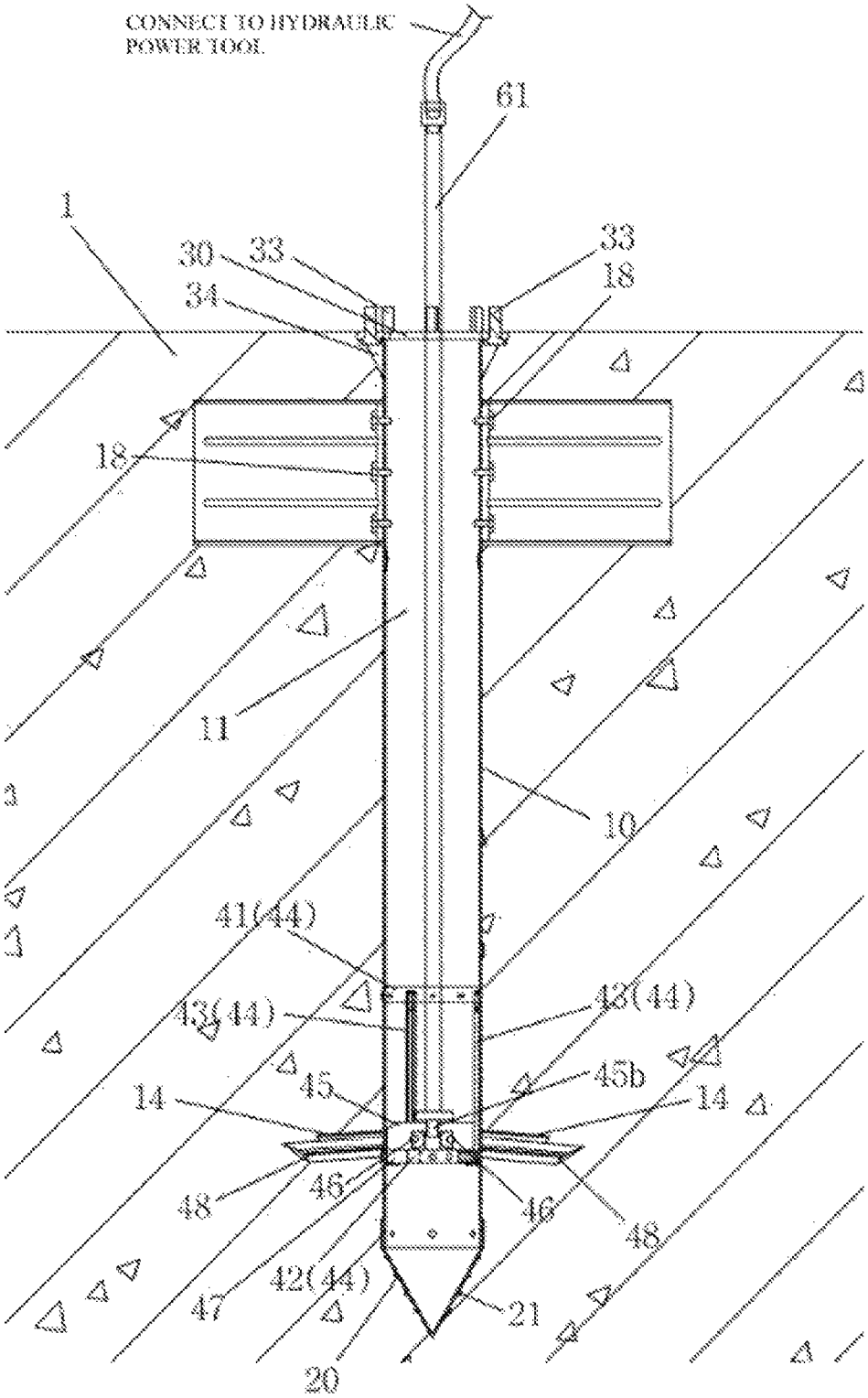
FIGS. 7*a* and 7*b* are cross-sectional views illustrating a method of inserting an anchor foundation mechanism according to the present disclosure.
Figure 7B:
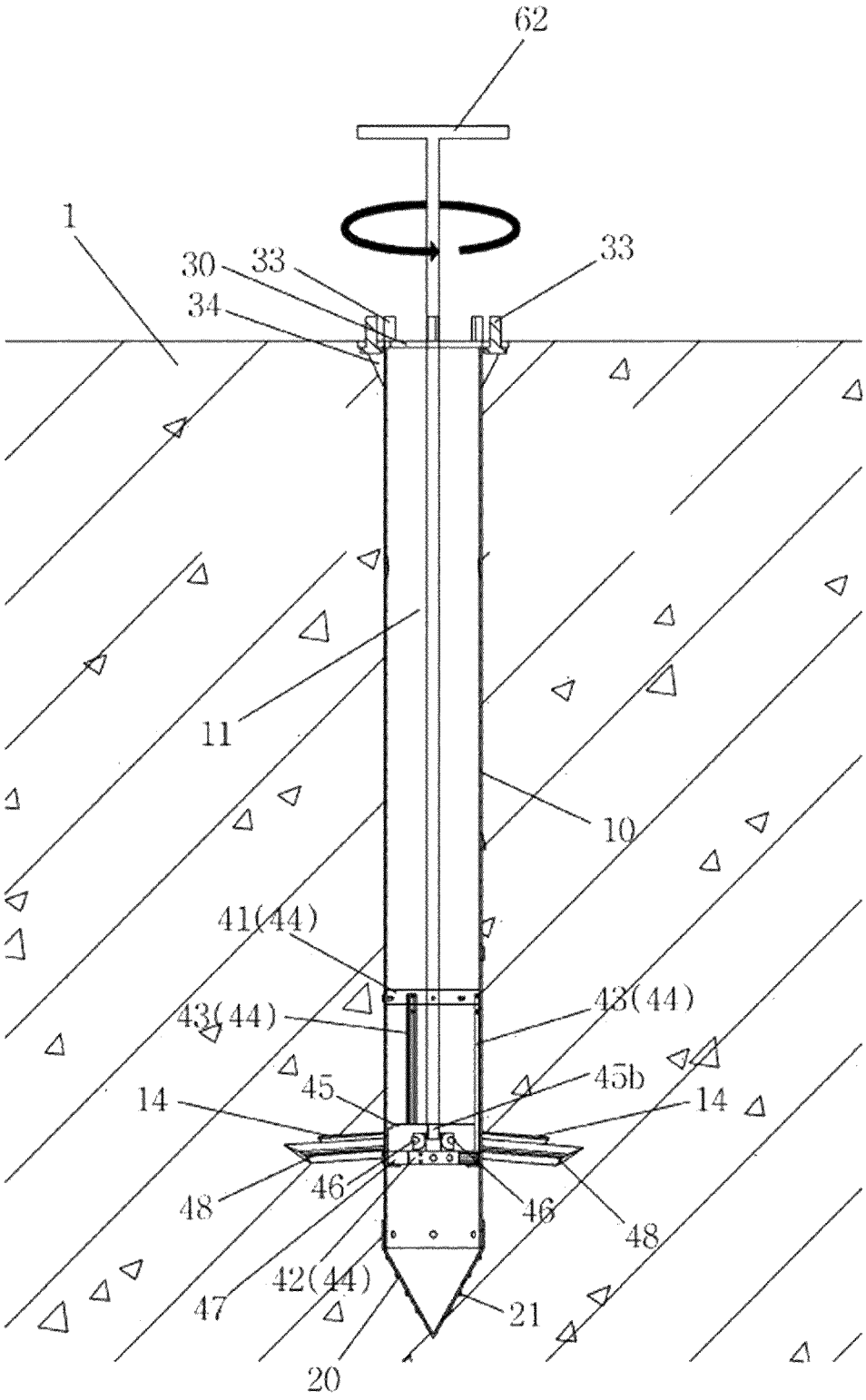
Figure 8:
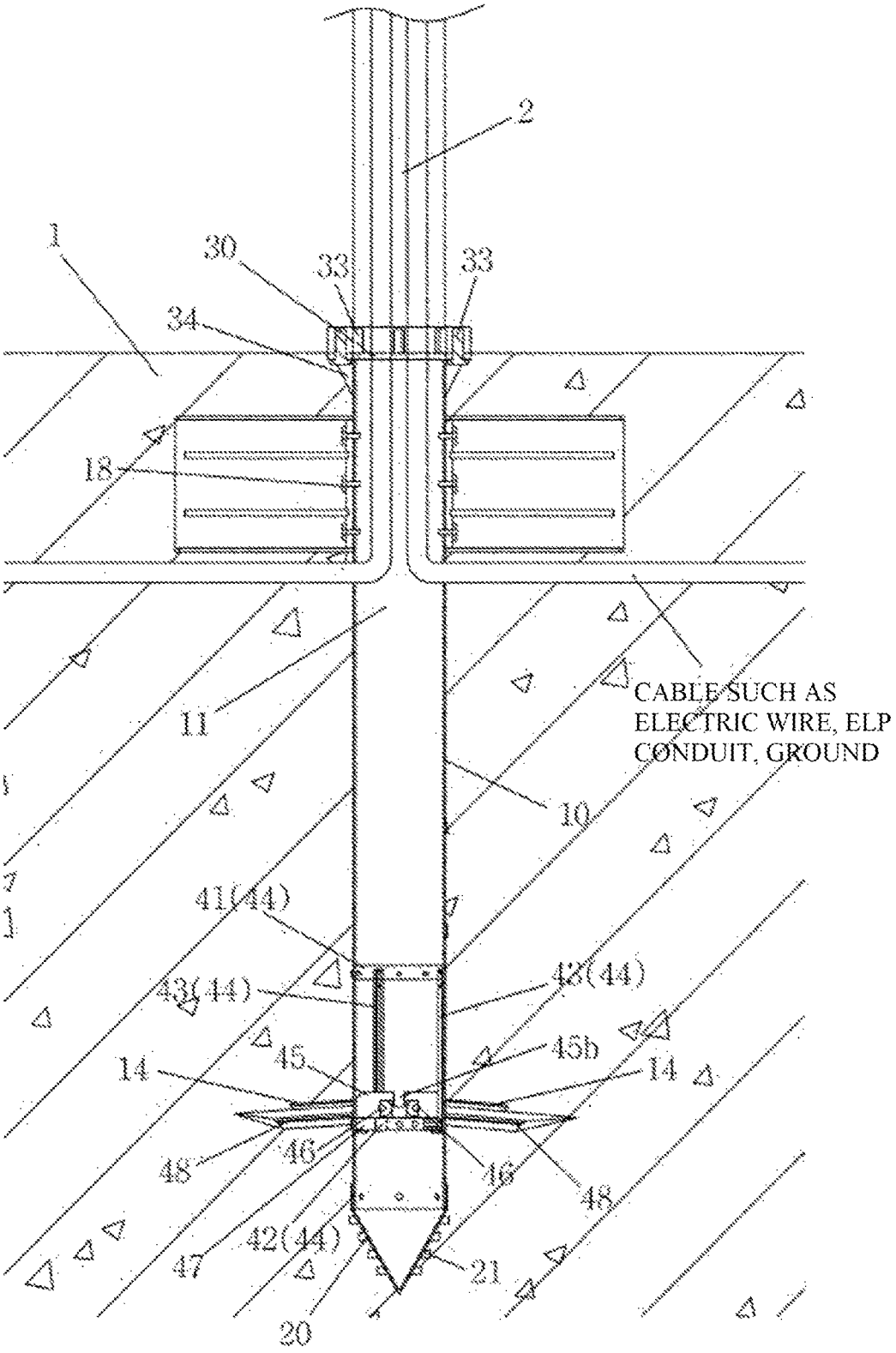
FIG. 8 is a cross-sectional view illustrating an installed state of an anchor foundation mechanism according to the present disclosure.
Figure 9A:
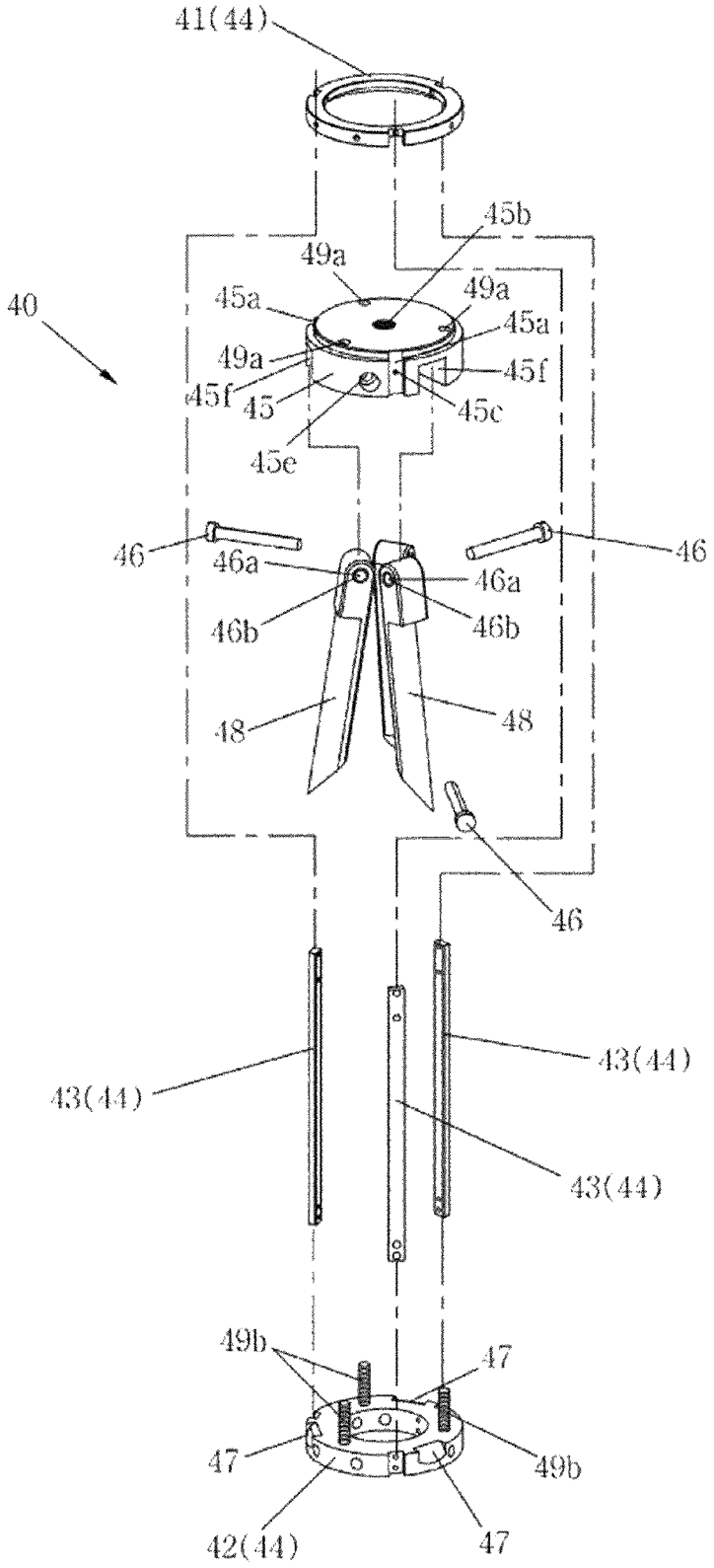
FIGS. 9*a* to 9*d* are a perspective view and operation perspective views illustrating an anchor assembly in an anchor foundation mechanism according to the present disclosure.
Figure 9B:
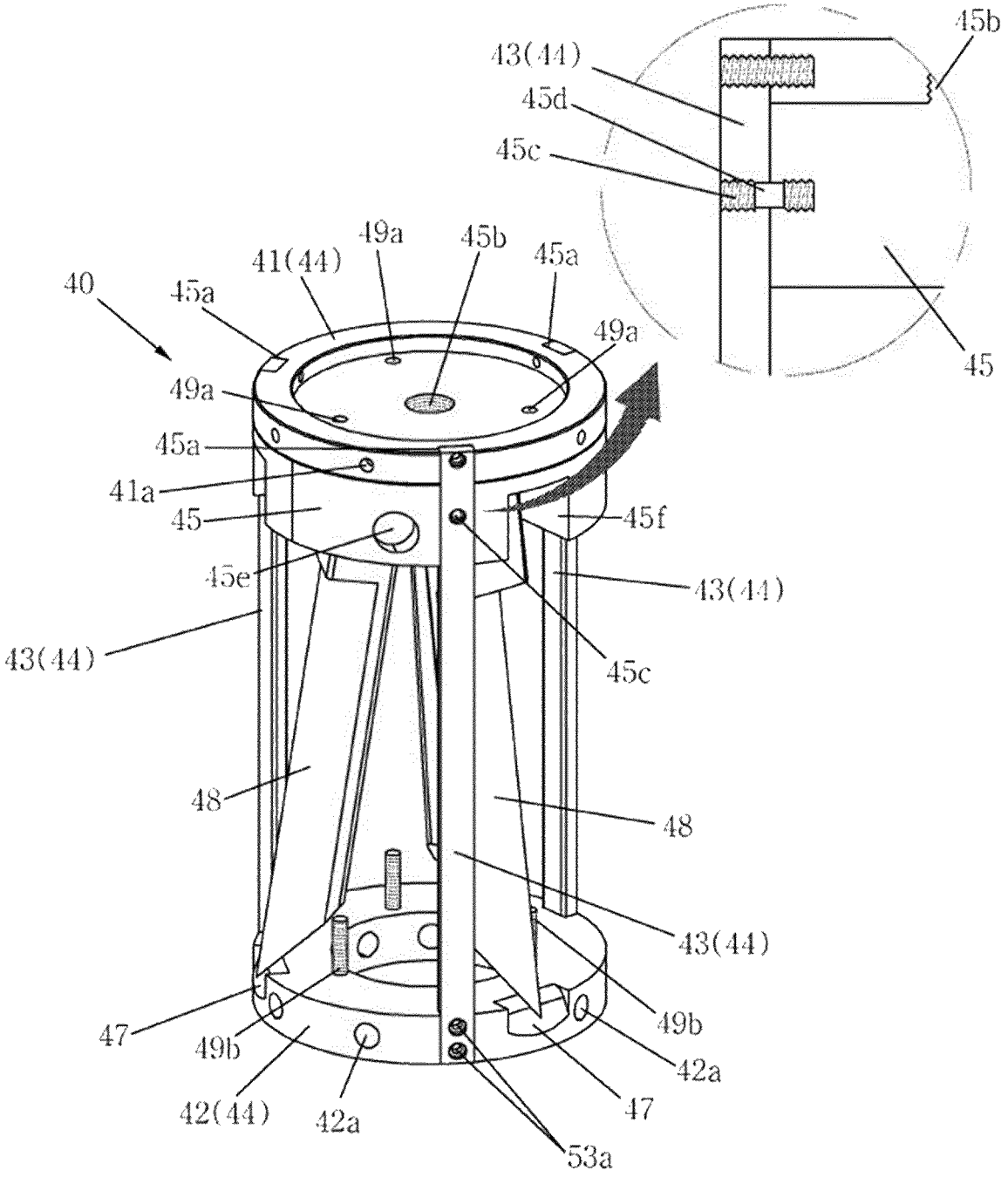
Figure 9C:
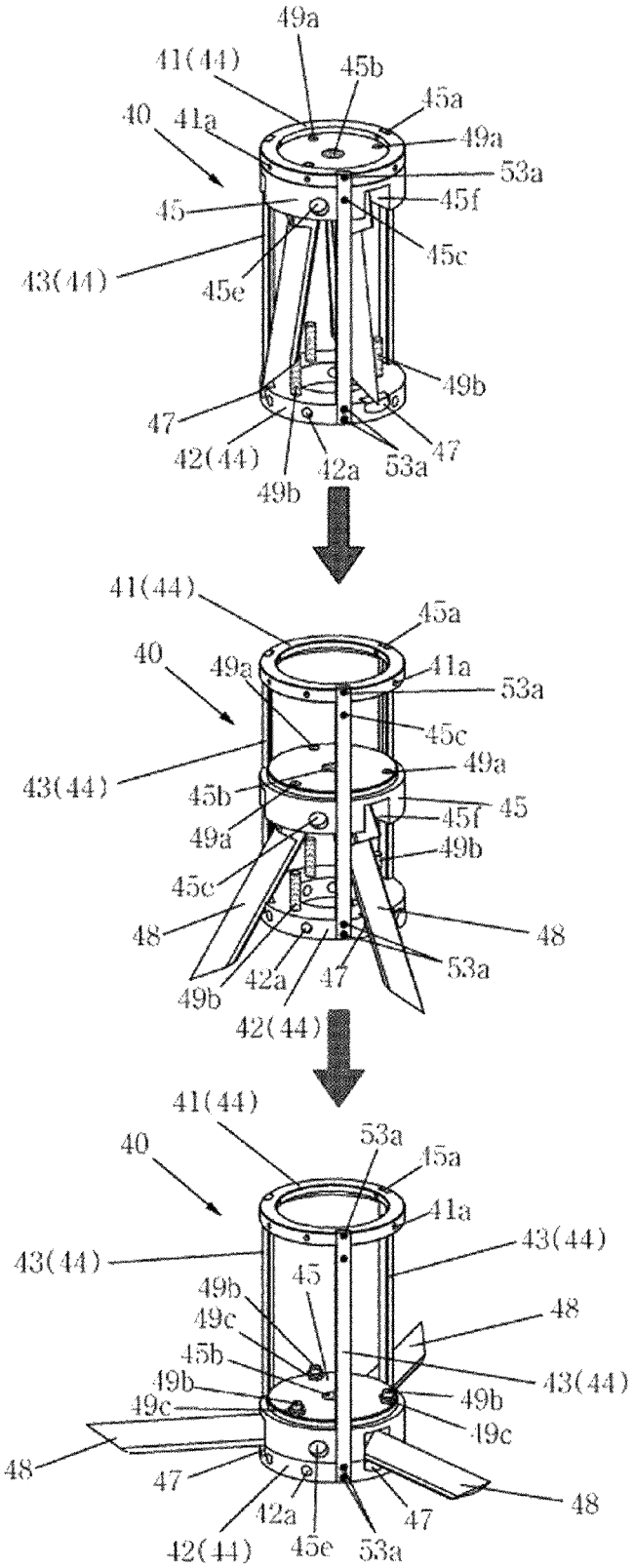
Figure 9D:
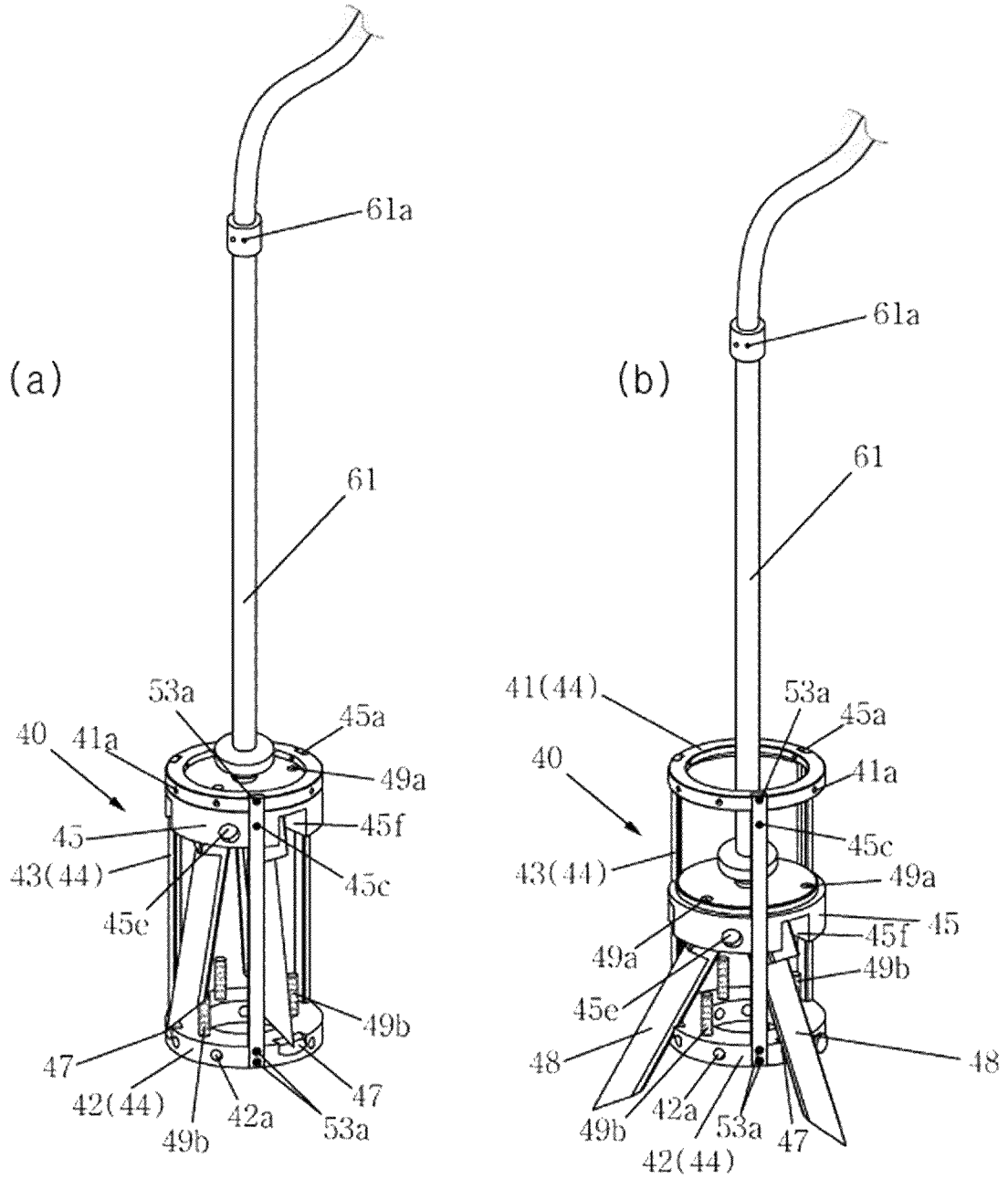
Figure 10A:
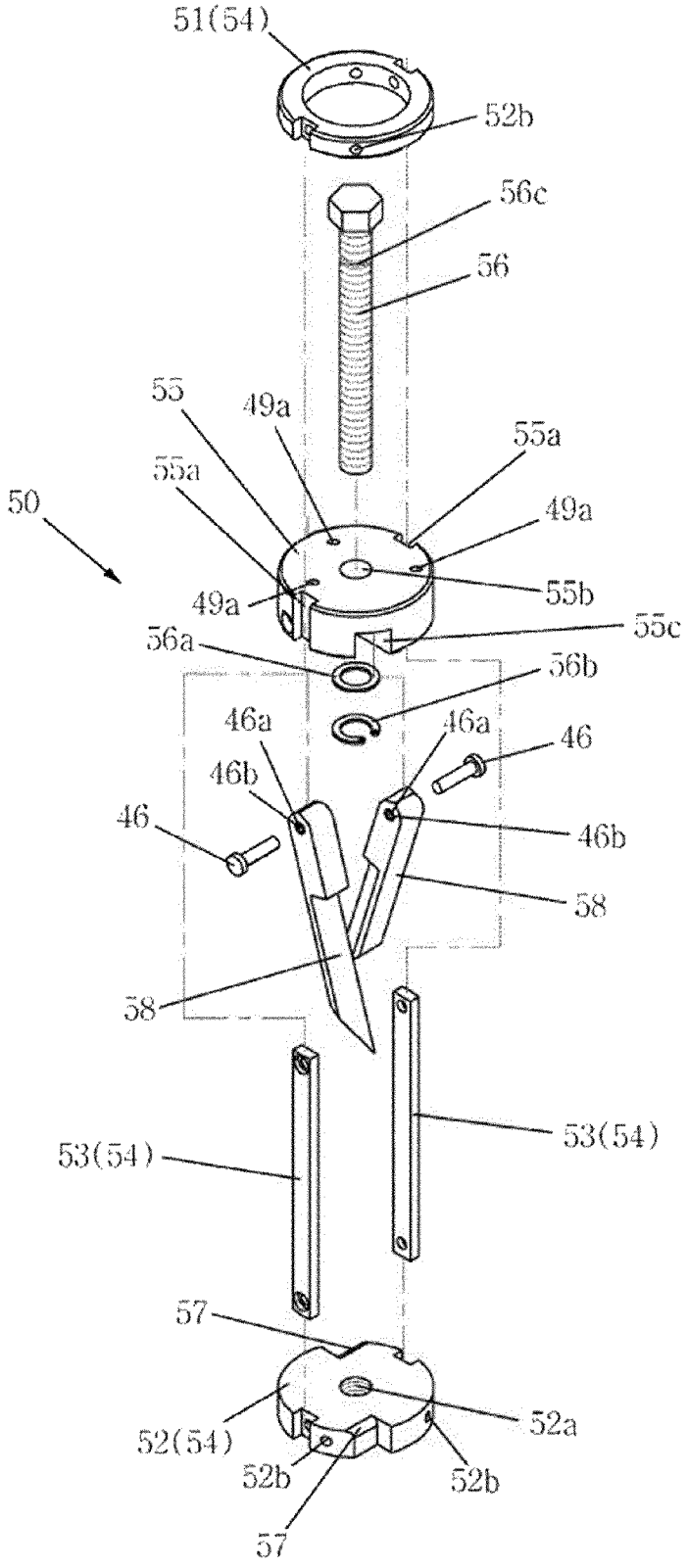
FIGS. 10*a* to 10*c* are a perspective view and operation perspective views illustrating another anchor assembly in an anchor foundation mechanism according to the present disclosure.
Figure 10B:
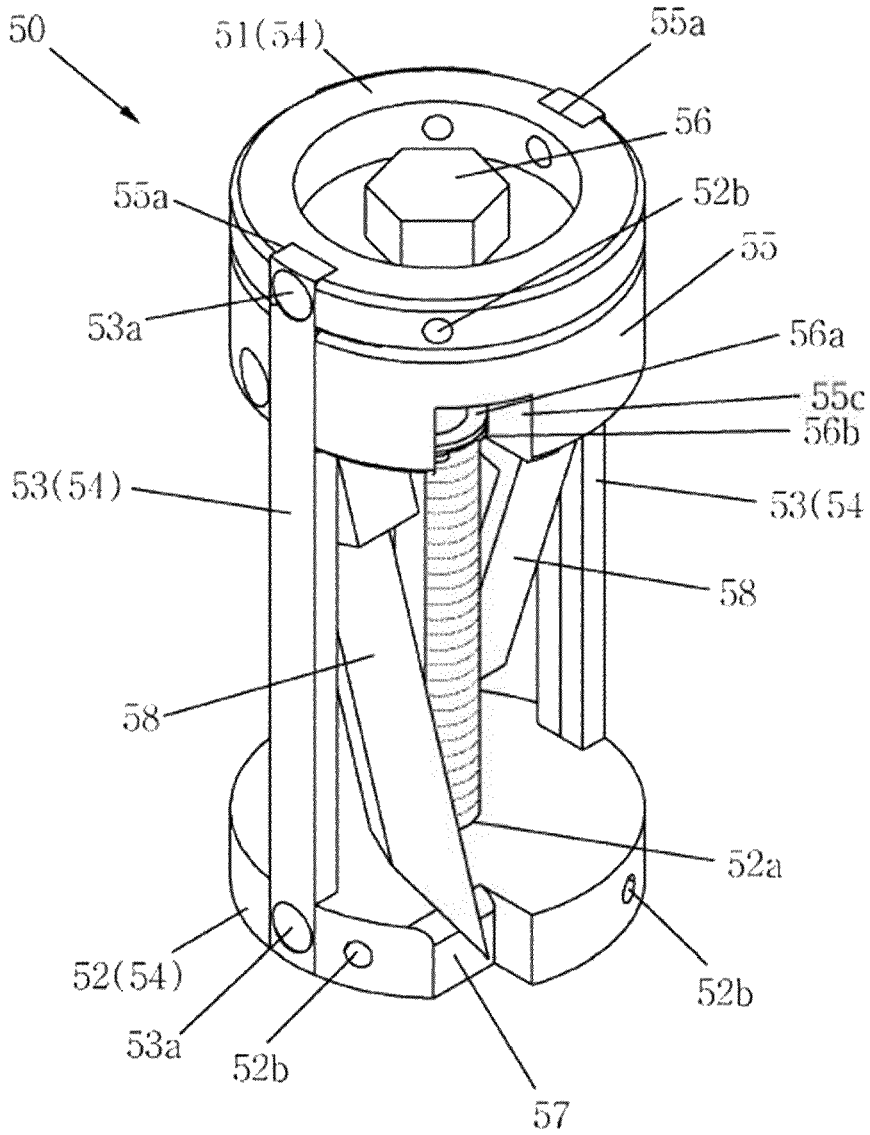
Figure 10C:
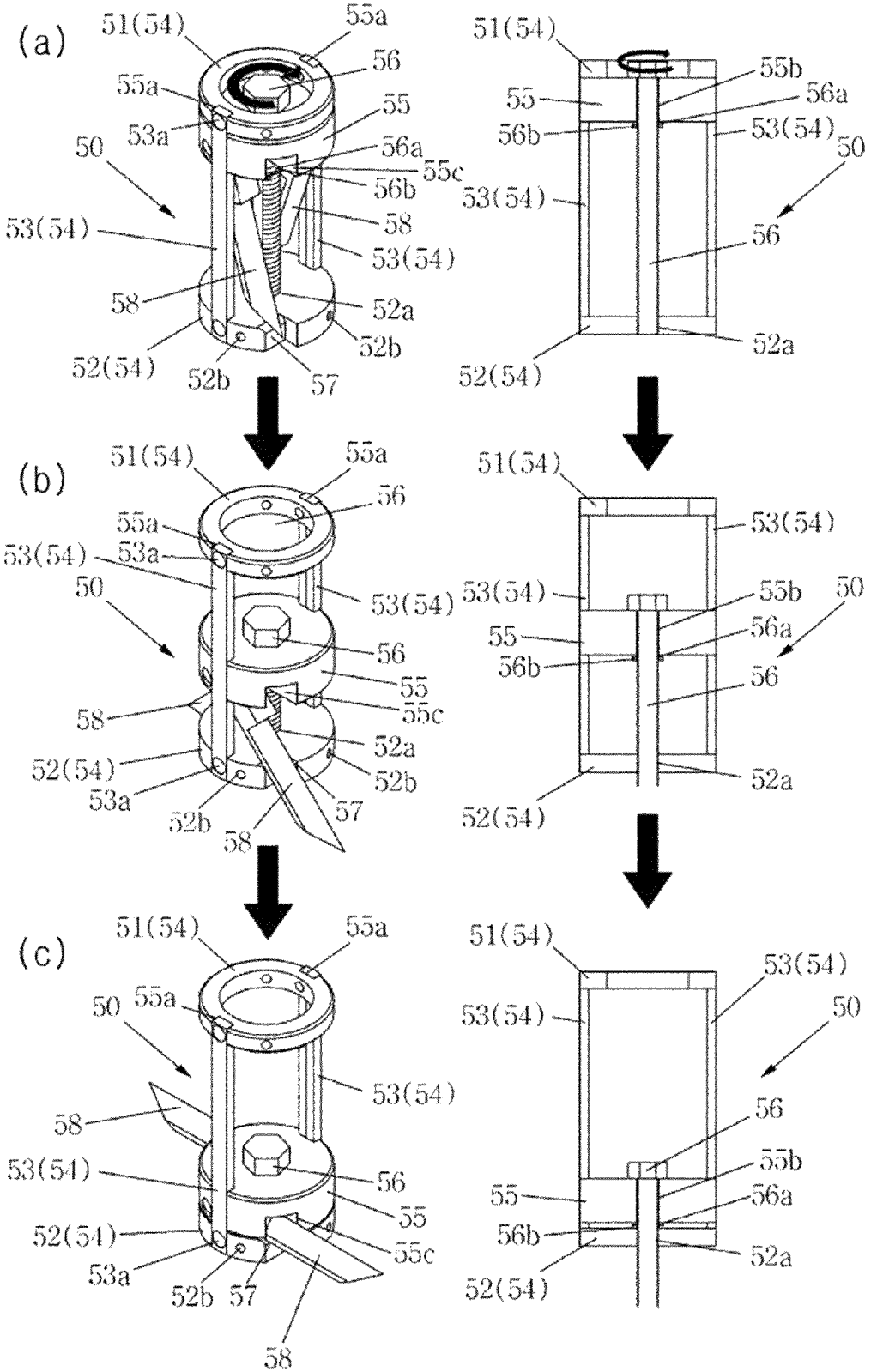
Figure 11:
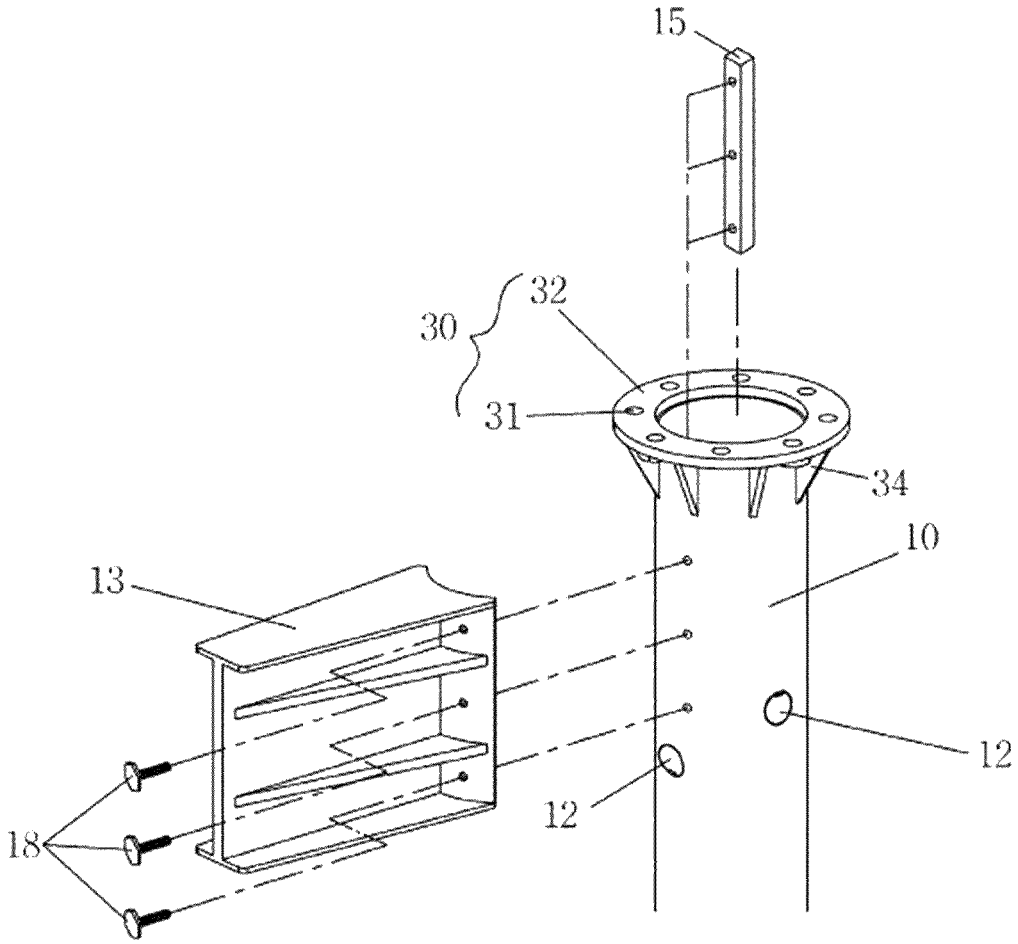
FIG. 11 is an exploded perspective view illustrating an anti-rotation plate of an anchor foundation mechanism according to the present disclosure.
Figure 12A:
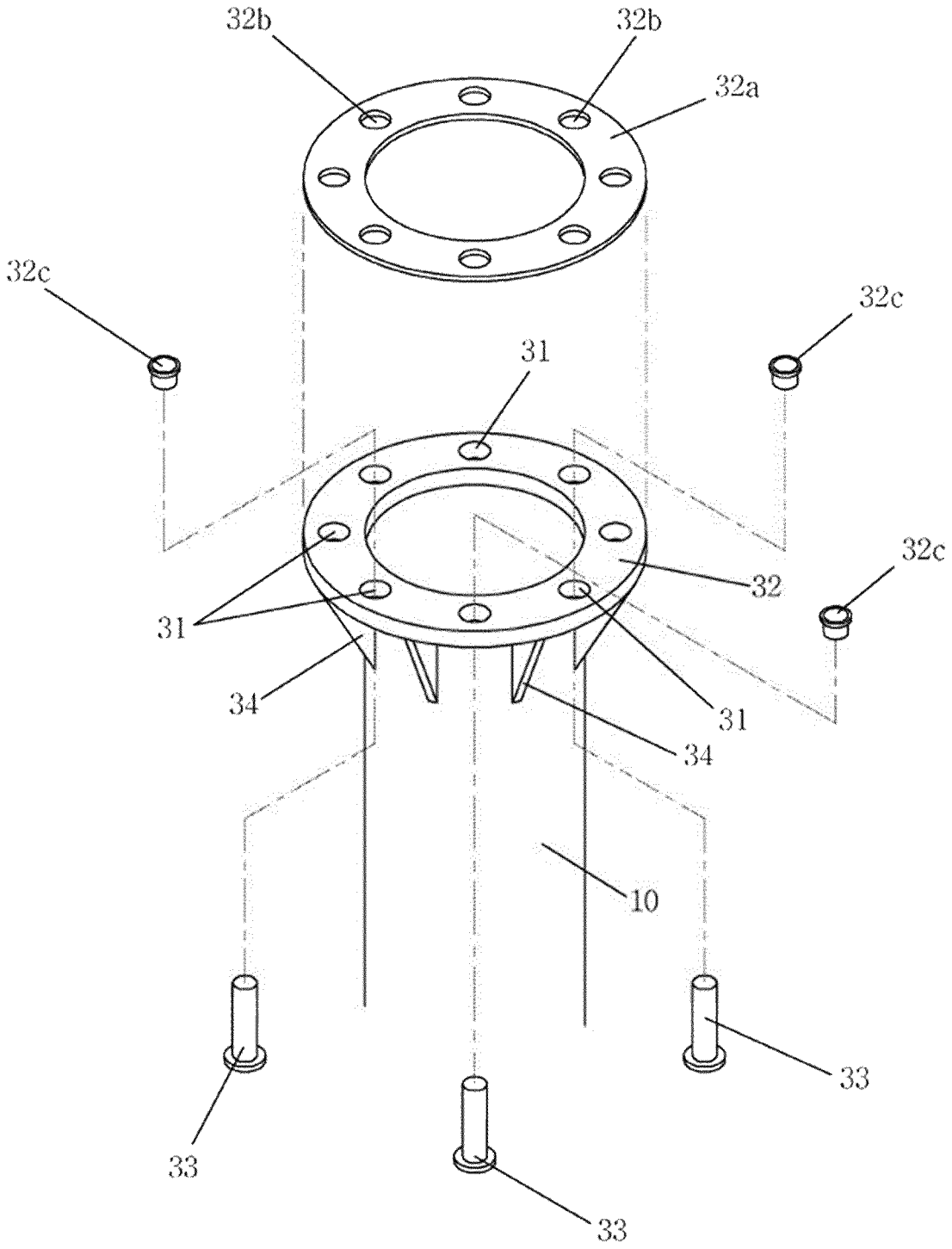
FIGS. 12*a* and 12*b* are an exploded perspective view and a perspective view of a flange according to an embodiment of the present disclosure.
Figure 12B:
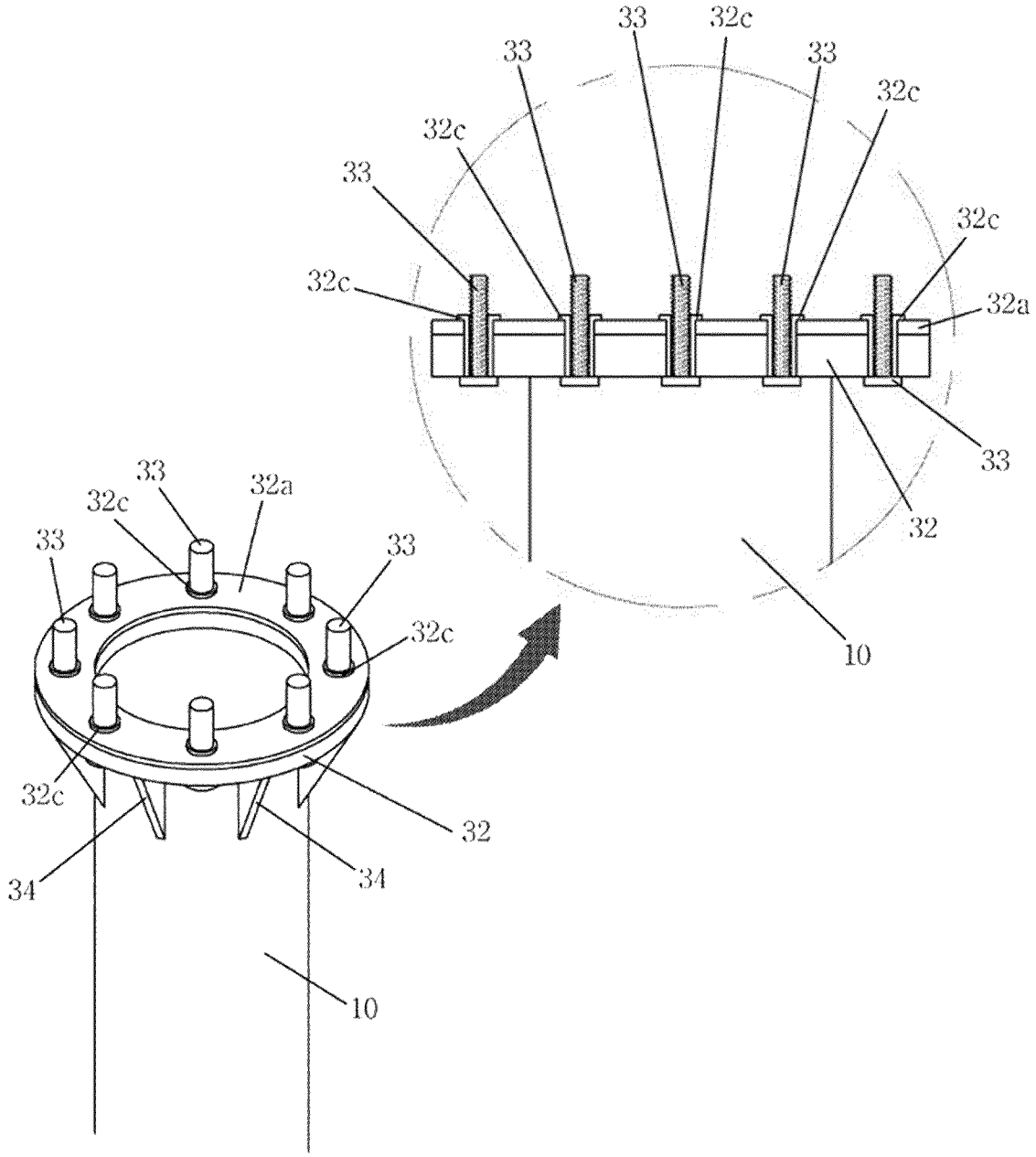
Figure 13A:
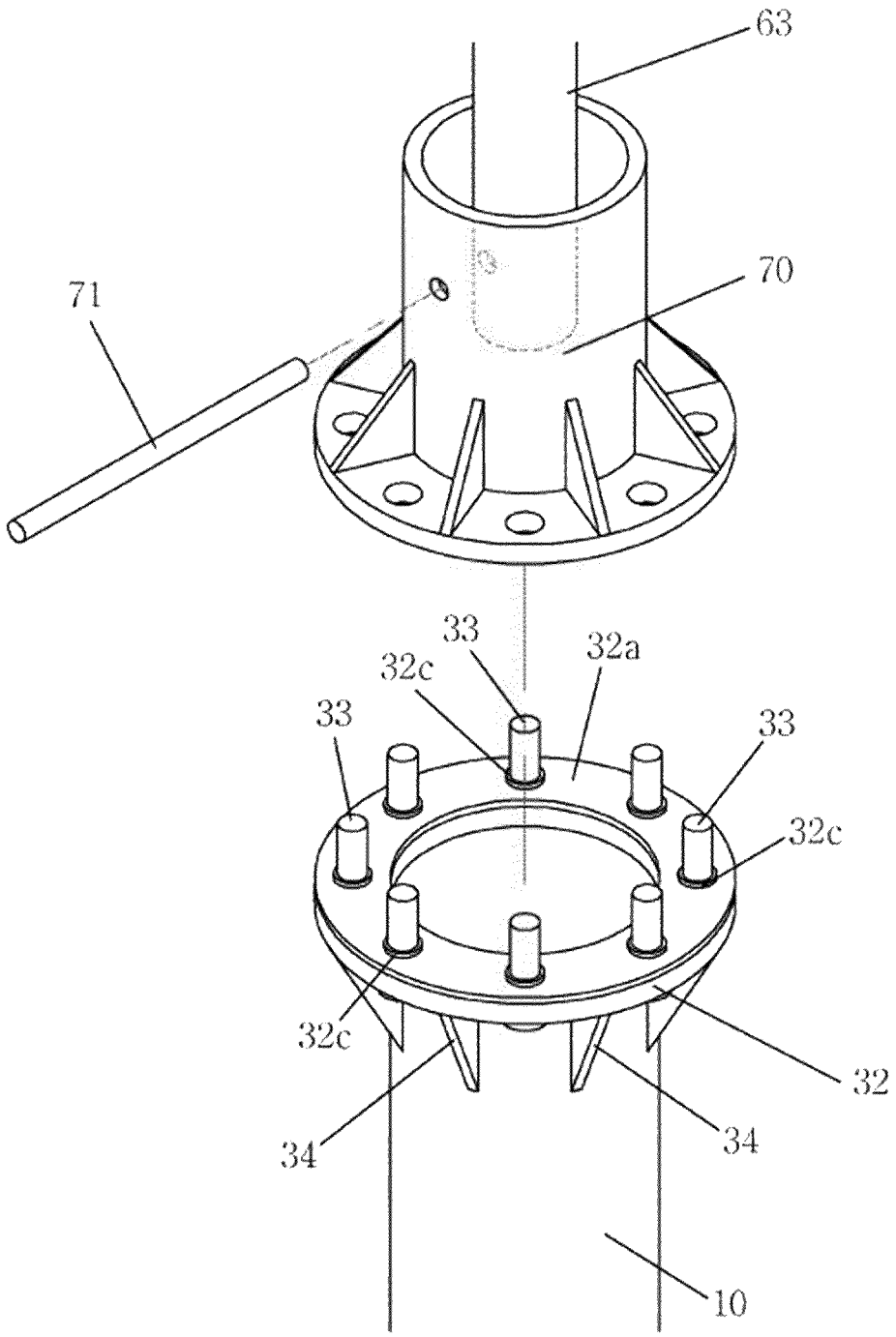
FIGS. 13*a* and 13*b* are an exploded perspective view and a perspective view of a rotary tool according to an embodiment of the present disclosure.
Figure 13B:
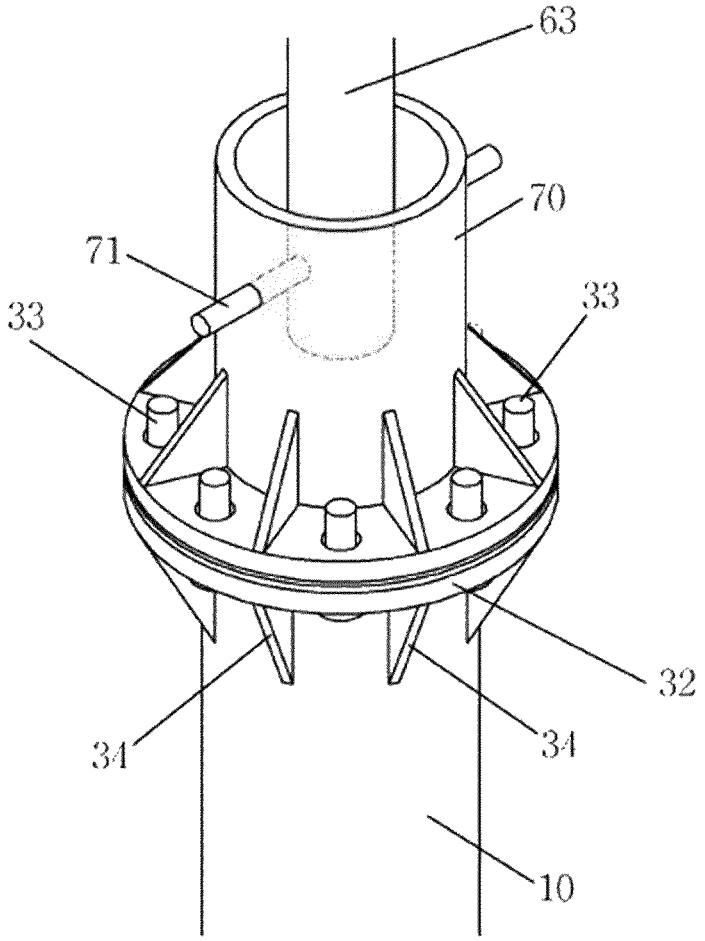

Hereinafter, preferred embodiments of the present disclosure will be described in detail with reference to the accompanying drawings.

The present disclosure relates to an anchor foundation mechanism for fixing a post 2 for supporting facilities such as a street light, a traffic light, a road signpost, a communication tower, solar power, various fences, or the like to the ground 1, and includes, as main components, a body 10, a cover part 20, a support 30, an anchor assembly 40 or 50, and the like.

The body 10 according to the present disclosure is formed to be inserted into the ground 1, and has a receiving space 11 therein. The body 10 is drilled with an auger drill at a certain circumference and depth such that the body 10 is inserted through a drilling machine into the ground 1 of a site where the facility is to be installed, and the body 10 Is inserted into the drilled site. As the body 10 is formed in the shape of a vertical tube, the receiving space 11 is formed on the inside thereof to accommodate the anchor assembly 40 or 50 to be described later. When the body 10 is inserted into the drilled site, it is well to make it exactly match the ground 1 vertically and horizontally such that the facility can be installed, and it is suitable to be formed in a circular tube shape to facilitate insertion into the drilled site. Although the body 10 is illustrated only in a circular shape, the body 10 may be formed in various shapes such as a square, a pentagon, and a hexagon, and thus the morphological aspect is not limited thereto.

In addition, the cover part 20 according to the present disclosure may be fixed to the bottom of the body 10 to facilitate insertion into the ground 1. The cover part 20 may be fixed to the bottom of the body 10 described above, that is, to the part of which the body 10 is first inserted into the drilled site in a state in which the cover part 20 is integrally formed by fastening or a separate bolt. The cover part 20 is formed in a cone shape where the portion in contact with the body 10 is formed in a circular shape, and the pointed portion is conspicuously formed toward the bottom. As described above, when inserting the body 10 into the drilled site, the support 30, which will be described later, is to be aligned with the ground 1. However, when the drilled site is formed through a drill, or the like, it is difficult to accurately form a hole, and thus it is necessary to adjust the support 30 with the cover part 20 such that the support 30 is aligned with the ground 1.

In addition, the support 30 according to the present disclosure is integrally formed on the upper side of the body 10 and is provided with a plurality of through-holes 31 and a flange 32 to allow the support 39 to be fixed to the post 2 after being exposed on the ground 1. The support 30, which has a configuration formed integrally with or coupled to the upper portion in the opposite direction of the cover part 20 mounted on the body 10 described above, is aligned with the ground 1, which makes it possible to mount the post 2 of the facility where a street light, a traffic light, a road signpost, a communication tower, solar power, various fences, or the like, are formed. In the support 30, a plurality of through-holes 31 are configured in a penetrating form to be fastened and fixed to the post 2, and a fastening bolt is formed to fix the facility, and the support 30 is configured to be seated on the ground 1 through the flange 32. In addition, the support 30 is configured to be inserted into the through-hole 31 to fix the facility through the facility fixing bolt 33 and then support the facility, and further includes force supporting pieces 34 such that the support 30 more closely bears the load of the facility.

In this case, the body 10 further includes a plurality of inlet holes 12 communicating with the receiving space 11 to enable power supply after inserting an electric wire, an ELP conduit, and a ground wire. One or more inlet holes 12 are formed in the body 10 to allow the insertion of the electric wire, the ELP conduit, and the ground wire such that power to enter the facility is supplied, and not to be exposed to the outside, which makes it possible improve the aesthetic and decorative beauty. Since the constitution of power supply is regulated to be buried in the ground 1 of about 40 to 60 cm underground, the electric wire, the ELP conduit, and the ground wire are inserted into the inlet holes 12 after excavating to an appropriate depth and width by an excavation operation, and then connected through the receiving space 11 of the body 10. When using facilities that do not require the electric wire, ELP conduit, and ground wire in the inlet holes 12, the inlet holes 12 are blocked with lids to prevent the inflow of foreign matter such as soil; on the other hand, when using facilities that require the electric wire, ELP conduit, and ground wire, lids are removed by using a tool such as a screwdriver such that the inlet holes 12 are penetrated, where the inlet holes 12 are connected only about 2 to 3 mm in the right and left 180 degrees direction.

Furthermore, the body 10 may further include an anti-rotation plate 13 for preventing rotation or subsidence from pressure by wind, or the like applied to the post 1. In this configuration, when a facility such as a streetlight, a traffic light, a road signpost, a communication tower, solar power, various fences, or the like are installed, not only the facility may be forcibly pressurized by external pressures such as wind, but the body 10 may be rotated together with the post 2 of the facility inside the ground 1, and thus in order to prevent the above problems, the anti-rotation plate 13 is mounted. In this case, it is advantageous for the anti-rotation plate 13 to be formed in a wide plate shape for preventing rotation, but the present disclosure is not limited thereto. When the anti-rotation plate 13 applies an individual fixing force to the body 10 only by an anti-rotation plate fixing bolt 18, the support capacity may be weakened by power natural disasters such as typhoons, earthquakes, hurricanes, or the like, and thus the anti-rotation plate 13 is mutually fixed by fastening the anti-rotation plate fixing bolt 18 through an anti-rotation plate nut 15 inserted into the body 10, which may greatly increase the fixing force. The anti-rotation plate 13 may or may not be installed depending on the facility. However, it would be desirable to install the anti-rotation plate 13 on the basic structures such as a communication tower, a street light, a traffic light, and a road signpost. In addition, when the excavation work is performed to bury the electric wire, ELP conduit, ground wire, or the like, the anti-rotation plate 13 is installed after inserting the electric wire, ELP conduit, ground wire, or the like into the inlet holes 12. In addition, the anti-rotation plate 13 is fixed to the body 10 by a separate anti-rotation plate fixing bolt 18, and it is fastened with the anti-rotation plate nut 15 and fixed.

Meanwhile, the cover part 20 according to the present disclosure is formed with a screw 21 on the outer surface to adjust the degree of insertion of the ground 1. In order for the support 30 to be aligned with the ground 1 when the body 10 is inserted into the site drilled with an auger drill as described above, the support 30 is rotated using a rotary tool 63 and then adjusted by the screw 21 for fine adjustment formed on the cover part 20 to easily insert the body 10 into the ground 1. That is, at the time of first drilling, since there may be some difference although the body 10 is to be accurately positioned above the ground 1, the body 10 may be further inserted into the ground 1 through the screw 21 formed on the outer surface of the cover part 20 as the support 30 is rotated using the rotary tool 63, or the like and thus and the body 10 is rotated, which makes it possible to adjust the height. The cover part 20 is fixed to the body 10 through a cover fixing bolt 17.

In addition, the anchor assembly 40 or 50 according to the present disclosure is formed in the receiving space 11 of the body 10 to be inserted and fixed on the inner side of the ground 1 to prevent rotation and forcibly pulling out, and includes the anchor pins 48 or 58 to support the load. In a state in which the upper support 41, 51 and the lower support 42, 52 are fixed with bolts in the receiving space 11 of the body 10, as the anchor assembly 40 or 50 is operated with the body 10 inserted inside the ground 1, the anchor pins 48 or 58 protruding while pushing a protruding cover 14 are embedded in the inner surface of the ground 1 to prevent the body 10 from being separated. In this way, the body 10, the anti-rotation plate 13 and the cover part 20 are inserted inside the ground 1, and are mutually coupled and fixed to the support 30 together with the post 2 formed in the facility such as a street light, a traffic light, a road signpost, a communication tower, and the solar power. The upper support 41 or 51 and the lower support 42 or 52 of the anchor assembly 40 or 50 are fixed to the body 10 with an anchor assembly fixing bolt 16.

In this case, as a first embodiment, the anchor assembly 40 includes a support portion 44 supported through a plurality of rails 43 between an upper support 41 and a lower support 42 fixed to an inside of the body 10, a transfer base 45 having rail grooves 45*a* to accommodate the rails 43 of the support portion 44 to allow the transfer base to transfer up and down and having a fastening nut 45*b* in the center, a plurality of anchor pins 48 having a side pin 46 on the transfer base 45 such that the anchor pins 48 move well, and slowly inserted and fixed inside the ground 1 while pushing the protruding cover 14 outward from an inclined groove 47 by downward transfer of the transfer base 45, and the anchor pin house 45*f*; on the other hand, as a second embodiment, the anchor assembly 50 includes a support portion 54 supported through a plurality of rails 53 between an upper support 51 and a lower support 52 fixed to an inside of the body 10, a transfer base 55 having rail grooves 55*a* to accommodate the rails 53 of the support portion 54 to allow the transfer base to transfer up and down and having a through-hole 55*b* for inserting a center bolt 56, a center bolt 56 fastened to a center bolt tab 52*a* of the lower support 52 by being inserted into the through-hole 55*b* of the transfer base 55 and then moving the transfer base 55 up and down through rotation, a washer 56*a* and a snap ring 56*b* for supporting the transfer base 55 to the center bolt 56, a plurality of anchor pins 58 having a side pin 46 on the transfer base 55 such that the anchor pins 58 move well and inserted and fixed inside the ground 1 outward from an inclined groove 47 by downward transfer of the transfer base 55 through rotation of the center bolt 56, and an anchor pin house 55*c*. In this case, any one of the configurations of the first embodiment and the second embodiment may be selected, but the fixing bolt tab 52*b* is capable of fixing the anchor assembly 50.

As described above, the anchor assembly 40 or 50 fixes the body 10 inside the ground 1 through two methods of the first embodiment and the second embodiments. First, in the anchor assembly 40, the transfer base 45 capable of being transferred along a plurality of rails 43 mounted on the support portion 44, where the rails 43 are fixed in the vertical direction are mounted between the upper support 41 and the lower support 42, are accommodated. The rail grooves 45*a* in the transfer base 45 are formed to the same as the rails 43 in number to keep the rails 43 inserted in the rail grooves 45*a*, and the fastening nut 45*b* is formed in the upper center of the transfer base 45. In addition, the plurality of anchor pins 48 are formed such that they may be inserted to the outside through the side pins 46 in the radial direction on the transfer base 45, and the inclined groove 47 is formed in the lower support 42 corresponding to the position where the anchor pin 48 is formed. Therefore, when inserting the body 10 and the cover part 20 into the ground 1, fastening the receiving space 11 of the body 10 to the fastening nut 45*b* formed in the upper center of the transfer base 45 through the exposed center of the support 30 with a fastening tool 61 by the operator, and then lowering the transfer base 45, the anchor pin 48 is opened radially along the inclined groove 47 as the transfer base 45 is lowered, so that the anchor pin 48 is embedded in the ground 1 and fixed. The transfer base 45 may be transferred down along the rails 43 by the load before an operation. In this case, as the anchor pin 48 remains open due to the movement of the transfer base 45, which may lead to the difficulty in the operation. Therefore, before the operation, the transfer base 45 always has to be positioned close to the upper support 41, and thus, a separate tab bolt 45*c* is to be provided for fixing. That is, the tab bolt 45*c* has a cutting portion 45*d* in the center, and the operator forcibly transfer the transfer base 45 downward with a fastening tool 61 or a rotary tool 63, and in this case, the transfer base 45 on the rails 43 is transferred downward while losing the fixing force due to the breakage of the cutting portion 45*d*. In addition, at least one rock bolt hole 49*a* is formed in the transfer base 45, and a rock bolt 49*b* protruding in the upper direction of the lower support 42 is provided so as to coincide directly below the rock bolt hole 49*a*, and when the transfer base 45 is transferred downward, the rock bolt 49*b* penetrates through the rock bolt hole 49*a* and protrudes to the outside. In this way, the rock bolt 49*b* and the rock bolt nut 49*c* are fastened and fixed, which makes it possible to keep the transfer base 45 remain in the lowered state. In addition, the side pin hole 45*e* allows the anchor pins 48 to be connected by inserting the side pin 46. In addition, the anchor pin house 45*f*, in which the anchor pins 48 are accommodated, is configured to guide the anchor pins 48 in the unfolding direction while limiting the movement of the anchor pins 48. In addition, the bolt tab 41*a* is formed on the upper support 41 to accommodate a separate bolt when fixing the anchor assembly 40. In other words, when the diameter pi(φ) of the body 10 is 150 mm or more, the anchor assembly 40 according to the present disclosure uses three or four anchor pins 48, and includes: the support portion 44 supported through a plurality of rails 43 between the upper support 41 and the lower support 42; the anchor pin house 45*f* having the rail grooves 45*a* to accommodate the rails 43 of the support portion 44 to enable up and down transfer and receiving the anchor pins 48 to hold the anchor pins such that the anchor pins 48 do not move right and left when the anchor pins 48 are fully open; and a plurality of anchor pins 48 having the side pin 46 and the side pin hole 46*a* on the transfer base 45 such that the anchor pins 48 move well and having the rock bolt hole 49*a* for the rock bolt 49*b* to pass through and tab bolts 45*c* on a side thereof for preventing the transfer base 45 from falling freely, in which by lowering a hydraulic power tool (not shown) in a state of connecting a lower fastening nut 45*b* of a fastening tool 61 to the fastening nut 45*b* provided in the center of the transfer base 45 and connecting an upper part of the fastening tool 61 to the hydraulic power tool with a U-shaped connecting pin and lowing the transfer base 45 by the force of the hydraulic power tool, the anchor pins 48 and the anchor pin house 45*f* slowly insert and fix the anchor foundation mechanism inside the ground 1 while pushing the protruding cover 14 outward from the inclined groove 47 by the downward transfer, and when the transfer base 45 is completely lowered, the rock bolt 49*b* fixed to the lower support 42 passes through the rock bolt hole 49*a* of the transfer base 45 and the rock bolt nut 49*c* is fastened to the rock bolt 49*b* to fix the transfer base 45 such that it does not move upward.

The anchor assembly 50 is provided with the transfer base 55 capable of transferring up and down along the plurality of rails 53 mounted on the support portion 54, where the rails 53 is vertically fixed between the upper support 51 and the lower support 52, and the rail grooves 55*a* are formed in the transfer base 55 to match the number of rails 53 such that the state in which the rails 53 is inserted in the rail grooves 55*a* is maintained, thereby making it possible to transfer the transfer base 55 up and down. In addition, the through-hole 55*b* is formed in the center of the transfer base 55 such that the center bolt 56 is fastened to the center bolt tab of the lower support 52 in a state of being inserted into the through-hole 55*b* from the top, and then the head of the center bolt 56 is fixed and rotated by an operator with a joint tool 62 such as a joint box. In this way, the transfer base 55 may be transferred up and down. In this case, the washer 56*a* and the snap ring 56*b* are inserted into a snap ring groove 56*c* of the center bolt 56 to support the lower portion of the transfer base 55, and accordingly, the transfer base 55 is transferred up and down with respect to the lower support 52. The transfer base 55 is formed such that a plurality of anchor pins 58 are spread out through the side pins 46 in the radial direction and the lower support 52 forms an inclined groove 57 corresponding to the position where the anchor pins 58 are formed. Accordingly, when lowering the transfer base 55 by inserting the body 10 and the cover part 20 into the ground 1 and then fixing and rotating the receiving space 11 of the body 10 and the head of the center bolt 56 through the exposed center of the support 30 with the joint tool 62 such as a joint box by the operator, the anchor pins 58 are opened in a radial form along the inclined groove 57 with the lowering of the transfer base 55 and the anchor pins 58 are embedded and fixed in the ground 1. In addition, the anchor pin house 45*f*, in which anchor pins 58 are accommodated, is configured to guide the anchor pins 58 in the unfolding direction while limiting the movement of the anchor pins 58. The rail 53 is provided with a fixing tab 53*a* to be fixed to the upper support 51 and the lower support 52.

In other words, when the diameter pi(φ) of the body is approximately 150 mm or less, the anchor assembly 50 according to the present disclosure may use two anchor pins 58, and further includes a support portion 54 supported through a plurality of rails 53 between an upper support 51 and a lower support 52 fixed to an inside of the body 10; an anchor pin house 55*c* having rail grooves 55*a* to accommodate the rails 53 of the support portion 54 to enable up and down transfer and receiving the anchor pins 58 to hold the anchor pins 58 such that the anchor pins do not move when the anchor pins 58 are fully open; a plurality of anchor pins 58 having a side pin 46 and a side pin hole 46*a* on the transfer base 55 such that the anchor pins 58 move well, and inserted and fixed inside the ground 1 while pushing a protruding cover 14 outward from an inclined groove 57 by downward transfer of the transfer base 55; and a foreign matter blocking seal 46*b* preventing foreign matter, groundwater, or the like from entering to prevent the anchor pin 58 from sticking on both sides where side pins 46 are inserted on the anchor pins 58.

In this case, the body 10 may further include the protruding cover 14 that is bent with some of the upper portions thereof being fixed to be opened in an upper direction by the anchor pins 48 and 58 while preventing inflow of foreign matter into the receiving space 11 of the body 10 when being inserted inside the ground 1. As described above, in order for the anchor pins 48 or 58 to be embedded and fixed in the ground 1 through the anchor assembly 40 or 50, a space in which the anchor pins 48 or 58 can protrude should be formed in the body 10, and when inserting the body 10 into the ground 1 in the space, soil or the like may flow into the receiving space 11 of the body 10 to interfere with the insertion of the anchor pins 48 or 58, and thus the protruding cover 14 is provided such that the flow into the body 10 does not occur when insertion into the drilled site in the ground 1 is performed. The protruding cover 14 is formed on the protruding portion of the anchor pins 48 or 58 on the body 10, and since only the upper two portions are connected to the body 10 by 2 to 3 mm, the protruding cover 14 keeps the closed state when normal, and protrudes together when the body 10 is inserted into the drilled site of the ground 1 and the anchor pins 48 or 58 by the anchor assembly 40 or 50 protrude, and thus the insertion of the anchor pins 48 or 58 is not obstructed by the inflow, thereby making it possible to carefully fix the body. In addition, separate foreign matter blocking seals 46*b* are installed at the mounting portions of the side pins 46 on both sides of the anchor pins 48 or 58 to prevent the anchor pins 48 or 58 from sticking and prevent foreign matter from entering.

In addition, when fixing the flange 32 of the support 30 and fixing parts of the facility post with a facility fixing bolt 33, an insulation plate 32*a* and an insulation washer 32*c* may be inserted between the flange 32 and the facility fixing part and fixed with a nut to block micro-current rising from the inside of the ground, protecting people and facilities.

In addition, all parts used in the anchor foundation mechanism may be basically subjected to plating treatment to prevent corrosion as much as possible.

In addition, the rotary tool 63 is mounted on the flange 32 of the support 30 and inserted on the support connector 70 fixed through the facility fixing bolt 33, and then is rotated with the support connector 70 fixed to the support 30 and inserted rotary tool 63 being fixed with the fixing pin 71, and in this way, the body 10 is inserted into the ground 1.

As described above, according to the present disclosure, it is possible to firmly fix a post supporting a base pillar of a streetlight, a traffic light, a road signpost, a communication tower, solar power, or various fences inside the ground to secure safety, to obtain a precise fixing force with ease of work and installation convenience by driving the anchor foundation mechanism inserted into the ground drilled with an auger drill deeply into the inner side of the ground through anchor pins of an anchor assembly for close fixing, to keep a neat appearance by configuring electric wires or additional facilities installed on a streetlight or a traffic light to be supplied with electric power so as not to be exposed to the outside, to prevent rotation and prevent forcible pulling out by external pressure by configuring an anti-rotation plate to support the post from numerous pressures applied on the post, to insert the anchor foundation mechanism 1 m to 5 m below the ground depending on the facility, and to smoothly recover the anchor foundation mechanism by returning the anchor pins of the anchor foundation mechanism to their original positions located inside when the facility reaches its end of life or moves its location.

The present disclosure is not limited to the disclosed embodiment, and it is apparent to those of ordinary skill in the art that various modifications and variations can be made without departing from the spirit and scope of the present disclosure. Therefore, such modifications or variations would fall within the scope of the claims of the present disclosure.

What is claimed is:

1. An anchor foundation mechanism with ease of fixing and an increased fixing force that fixes a post for supporting a facility of a streetlight, a traffic light, a road signpost, a communication tower, solar power, and various fences to a ground, the anchor foundation mechanism comprising:

a vertical cylindrical tubular body formed to be inserted into the ground and having a receiving space therein;

a cover part fixed to a bottom of the body by bolts and configured to be inserted into the ground;

a support integrally formed with a top of the body and providing with a plurality of through-holes and a flange to allow the support to be fixed to the post after being exposed on the ground; and an anchor assembly formed in the receiving space of the body and having anchor pins for driving the body deeply into the ground and then tightly fixing the body so as to support a load, prevent rotation, and prevent forced pulling out, wherein the anchor assembly includes:

a support portion supported through a plurality of rails between an upper support and a lower support fixed to an inside of the body;

a transfer base having rail grooves to accommodate the rails of the support portion to allow the transfer base to transfer up and down and having a fastening nut for connecting a fastening tool in the center;

a plurality of anchor pins having a side pin and a side pin hole on the transfer base such that the anchor pins move well, and inserted and fixed inside the ground while pushing a protruding cover outward from an inclined groove by downward transfer of the transfer base; and a foreign matter blocking seal preventing foreign matter and groundwater from entering on an anchor pin house for accommodating the anchor pin and the anchor pin to prevent the anchor pin from sticking, a rock bolt and a rock bolt nut being fastened such that the transfer base is fixed after downward transfer, or wherein the anchor assembly includes:

a support portion supported through a plurality of rails between an upper support and a lower support fixed to an inside of the body;

a transfer base having rail grooves to accommodate the rails of the support portion to allow the transfer base to transfer up and down and having a through-hole for inserting a center bolt;

a center bolt fastened to a center bolt tab of the lower support by being inserted into the through-hole of the transfer base and then moving the transfer base up and down through rotation;

a washer and a snap ring supporting the transfer base to the center bolt:

a plurality of anchor pins having a side pin on the transfer base such that the anchor pins move well, and inserted and fixed inside the ground while pushing the protruding cover outward from an inclined groove by downward transfer of the transfer base through rotation of the center bolt;

an anchor pin house; and the foreign matter blocking seal preventing foreign matter and groundwater on the anchor pin from entering to prevent the anchor pin from sticking.

2. The anchor foundation mechanism of claim 1, wherein the body further includes a plurality of inlet holes that communicate with the receiving space and through which an electric wire, an ELP conduit, a ground wire, or the like are inserted to facilitate power supply.

3. The anchor foundation mechanism of claim 1, wherein the body further includes an anti-rotation plate for preventing rotation or subsidence from pressure by wind or the like applied to the post.

4. The anchor foundation mechanism of claim 1, wherein the cover part has a cone-shaped cover and a screw formed on an outer surface such that a degree of insertion into the ground is adjusted by using a rotary tool.

* * * * *